US008362405B2

(12) United States Patent
Hasegawa

(10) Patent No.: US 8,362,405 B2
(45) Date of Patent: Jan. 29, 2013

(54) HEATER CONTROLLER OF EXHAUST GAS SENSOR

(75) Inventor: Jun Hasegawa, Komaki (JP)

(73) Assignee: Denso Corporation, Kariya (JP)

( * ) Notice: Subject to any disclaimer, the term of this patent is extended or adjusted under 35 U.S.C. 154(b) by 1058 days.

(21) Appl. No.: 12/350,437

(22) Filed: Jan. 8, 2009

(65) Prior Publication Data

US 2009/0184105 A1 Jul. 23, 2009

(30) Foreign Application Priority Data

Jan. 18, 2008 (JP) ..... 2008-009854
Jan. 21, 2008 (JP) ..... 2008-010165

(51) Int. Cl.
*H05B 1/02* (2006.01)

(52) U.S. Cl. ..... 219/497; 219/492; 219/205; 123/676; 123/678

(58) Field of Classification Search ..... 219/492, 219/497, 501, 505, 202–206; 123/676, 678, 123/679
See application file for complete search history.

(56) References Cited

U.S. PATENT DOCUMENTS 4,715,343 A * 12/1987 Kinoshita ..... 73/23.32
6,781,098 B2 * 8/2004 Toyoda ..... 219/501
2003/0233900 A1 12/2003 Fujikawa et al.
2005/0205550 A1 9/2005 Saito et al.
2007/0271904 A1 11/2007 Shouda et al.

FOREIGN PATENT DOCUMENTS

| | | |
|---|---|---|
| JP | 07-027742 | 1/1995 |
| JP | 8-150213 | 6/1996 |
| JP | 8-232746 | 9/1996 |
| JP | 2002-048749 | 2/2002 |
| JP | 2002-318219 | 10/2002 |
| JP | 2003-97323 | 4/2003 |
| JP | 2007-113920 | 5/2007 |
| JP | 2007-120390 | 5/2007 |

OTHER PUBLICATIONS

Japanese Office Action dated Sep. 2, 2011, issued in corresponding Japanese Application No. 2008-009854 with English Translation.

* cited by examiner

*Primary Examiner* — Mark Paschall
(74) *Attorney, Agent, or Firm* — Nixon & Vanderhye P.C.

(57) ABSTRACT

A reference heater energization delay time is established according to an engine conditions (shift range, cooling water temperature, intake-air temperature, ambient temperature, and oil temperature) during starting period. An extension delay time is established according to an engine condition after starting period. A final heater energization delay time is established by adding the extension delay time to the reference heater energization delay time. Until an elapsed time after starting period of engine reaches the final heater energization delay time, an energization of a heater of an exhaust gas sensor is inhibited. When the elapsed time after starting period of engine reaches the final heater energization delay time, the energization of the heater is started to heat a sensor element.

4 Claims, 21 Drawing Sheets

HEATER CONTROLLER OF EXHAUST GAS SENSOR

CROSS-REFERENCE TO RELATED APPLICATION

This application is based on Japanese Patent Applications No. 2008-9854 filed on Jan. 18, 2008, and No. 2008-10165 filed on Jan. 21, 2008, the disclosures of which are incorporated herein by reference.

FIELD OF THE INVENTION

The present invention relates to a heater controller of an exhaust gas sensor. The heater controller controls an energization of a heater that heats a sensor element of the exhaust gas sensor in order to control temperature of the sensor element.

BACKGROUND OF THE INVENTION

An internal combustion engine is provided with an exhaust gas sensor (an air-fuel ratio sensor, or an oxygen sensor) for detecting an air-fuel ratio or a rich/lean state of an exhaust gas in an exhaust pipe. A fuel injection quantity is feedback-controlled so that the air-fuel ratio of the exhaust gas agrees with a target air-fuel ratio on the basis of an output of the exhaust gas sensor. Generally, since the detection precision of the exhaust gas sensor is low until the temperature of the sensor element rises to activation temperature, the sensor element is heated by a heater provided in the exhaust gas sensor to promote activation of the exhaust gas sensor.

Exhaust gas of an internal combustion engine contains water vapor generated by combustion reaction between fuel and air. When the temperature of the exhaust pipe is low immediately after starting period of the internal combustion engine, the exhaust gas containing the water vapor is cooled down in the exhaust pipe. In some cases, the water vapor in the exhaust gas in the exhaust pipe is condensed and condensate water is generated. Consequently, there is a possibility that the condensate water generated in the exhaust pipe immediately after starting period of engine adheres to the sensor element in the exhaust gas sensor. When the sensor element is heated by the heater immediately after starting period of engine, the high-temperature sensor element heated by the heater may be broken due to a local cooling (heat distortion) caused by adhesion of the condensate water. This is referred to as an element breaking, hereinafter.

JP-2003-328821A shows a heater energization delay time (heater off time) is established according to a coolant temperature during starting period of engine. When the delay time has elapsed, it is determined that the exhaust pipe temperature has risen to a temperature at which no condensate water is generated in the exhaust pipe, so that an energization of the heater is started.

Further, to increase the precision of the heater energization delay time, as described in JP-2007-321561A, reference heater energization delay time is established according to the lowest temperature among coolant temperature, intake-air temperature, and ambient temperature during starting period of engine. Correction time is established according to a difference between the coolant temperature and the ambient temperature (or a difference between the coolant temperature and the intake-air temperature). A final heater energization delay time is established by correcting the reference heater energization delay time with the correction time. After the final heater energization delay time has passed, the energization of the heater is started.

As described in JP-2007-120390A, while regulating energization duty of a heater, electric current is applied to the heater so as to preheat a sensor element of an exhaust gas sensor at a temperature at which no element breaking due to water adhesion occurs until a predetermined preheat period is elapsed. After the preheat period is elapsed, the energization duty of the heater is increased to make the temperature of the sensor element rise to the activation temperature.

An exhaust heat quantity after engine starting period changes according to an engine condition after starting period. A time necessary for the temperature of the exhaust pipe to rise to a temperature at which no condense water is generated in the exhaust pipe (that is, heater energization delay time necessary to prevent the element breaking of the exhaust gas sensor) changes.

In JP-2003-328821A and JP-2007-321561A, the heater energization delay time is established according to only engine condition during starting period such as a coolant temperature without considering a change in the exhaust heat quantity according to an engine condition after starting period. Consequently, the heater energization delay time has to be established to rather long time in consideration of an allowance on a safety side. A start of energizing the heater delays, an activation of the exhaust gas sensor delays, a start of air-fuel-ratio feedback control delays, and exhaust emission deteriorates.

JP-2002-48749A shows that an exhaust gas heat quantity (or exhaust gas temperature) is calculated on the basis of an operation state of the internal combustion engine. The exhaust pipe temperature is estimated on the basis of the exhaust gas heat quantity (or the exhaust gas temperature) and a heat transfer model obtained by mathematically modeling a heat transfer between exhaust gas and the exhaust pipe and a heat transfer between the exhaust pipe and the outside air. When the exhaust pipe temperature rises to a temperature at which water vapor in the exhaust gas is not condensed in the exhaust pipe, the energization of the heater is started.

However, a computing process necessary to estimate exhaust pipe temperature using the heat transfer model is complicated. A computation load on the controller increases, and the high precision of estimation of the exhaust pipe temperature is necessary.

In JP-2007-120390A, the heater energization duty is established only according to an engine condition during starting period without respect to a change in the exhaust heat quantity due to a change in the engine condition during a preheat period. Consequently, the heater energization duty has to be established to a rather low energization duty on the safe side. Accordingly, a preheat temperature of the sensor element becomes low, a time to increase the temperature of the sensor element to activation temperature after the preheat period becomes long, a start of air-fuel-ratio feedback control delays, and an exhaust emission deteriorates.

SUMMARY OF THE INVENTION

The present invention is made in view of the above matters, and it is an object of the present invention to provide a heater controller of an exhaust gas sensor realizing an early activation of a sensor element while preventing an element breaking in the exhaust gas sensor.

According to an aspect of the present invention, a heater controller of an exhaust gas sensor is provided with a heater energization control means for controlling energization of a heater for heating a sensor element of an exhaust gas sensor The exhaust gas sensor is provided in an exhaust passage in an internal combustion engine. The heater controller has: a delay time establishing means for establishing a reference heater energization delay time until start of energization of the heater in accordance with an engine condition during starting period; and a delay time correcting means for correcting the reference heater energization delay time in accordance with an engine condition after starting period and establishing a final heater energization delay time. When the final heater energization delay time elapses after starting period of the internal combustion engine, an energization of the heater is started.

In a method of correcting heater energization delay time, for example, a final heater energization delay time may be established by adding an extension delay time which is established according to an engine condition after starting period to a reference heater energization delay time which is established according to an engine condition during starting period.

Final heater energization delay time=Reference heater energization delay time+Extension delay time Alternatively, the final heater energization delay time may be established by multiplying the reference heater energization delay time with a correction coefficient which is established according to the engine condition after starting period.

Final heater energization delay time=Reference heater energization delay time×Correction coefficient As described above, when the heater energization delay time is established by correcting the reference heater energization delay time in accordance with the engine condition after starting period, the heater energization delay time can be established in consideration of both engine conditions during and after starting period. Consequently, corresponding to a change in time necessary for increasing the temperature in the exhaust pipe after starting period of the engine up to a temperature at which no condensate water is generated, the heater energization delay time can be corrected to proper time after starting period of the engine to prevent an element breaking of the exhaust gas sensor. The precision of the heater energization delay time can be increased by a relatively simple process, and both early activation of the exhaust gas sensor and the element breaking prevention can be realized.

When it is determined that condensate water is generated in the exhaust passage after starting period of the engine, the heater energization delay time which is established according to an engine condition during starting period may be extended. Thereby, an energization of the heater can be stopped reliably in a period in which condensate water is generated in the exhaust passage, and an element breaking of the exhaust gas sensor can be prevented more reliably.

When it is determined that condensate water generated in the exhaust passage after starting period of the engine is splashed, the heater energization delay time which is established according to the engine condition during starting period may be extended. Thereby, an energization of the heater can be stopped reliably in a period in which condense water is splashed, and an element breaking of the exhaust gas sensor can be prevented more reliably.

In a case that condensate water is not generated in the exhaust passage, the heater energization delay time which is established according to the engine condition during starting period may be shortened. In a case that condense water generated in the exhaust passage is not splashed, the heater energization delay time may be shortened. Thereby, the heater energization delay time is shortened within the range in which an element breaking of the exhaust gas sensor can be prevented, and early activation of the exhaust gas sensor can be realized.

According to another aspect of the present invention, a heater controller includes preheat control means for regulating an energization of the heater so as to preheat the sensor element of the exhaust gas sensor within a temperature range in which an element breaking due to adhesion of water does not occur until a predetermined preheat period elapses after starting period of an engine. The preheat control means corrects an energization quantity of the heater in accordance with an engine condition during the preheat period.

According to the above configuration, in correspondence with increase or decrease in a heat quantity supplied to the sensor element, the energization quantity (heat generation quantity) of the heater is corrected so as to be decreased or increased to reduce the influence of the increase or decrease in a heat quantity. The preheat temperature of the sensor element determined by the heat generation quantity of the heater and the exhaust heat quantity can be controlled to a temperature higher than the conventional temperature within the temperature range in which no element breaking due to adhesion of water occurs. While preventing element breaking of the exhaust gas sensor, early activation of the sensor element can be realized.

It is also possible to increase the energization quantity of the heater when it is determined that condensate water is not generated in the exhaust passage during the preheat period. It is also possible to increase the energization quantity of the heater when it is determined that condensate water generated in the exhaust passage is not splashed during the preheat period. The preheat temperature of the sensor element can be controlled to a temperature higher than a conventional temperature within the temperature range in which no element breaking due to adhesion of water occurs during the preheat period.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Embodiments of the present invention will be described hereinafter.

[First Embodiment]

Figure 1:
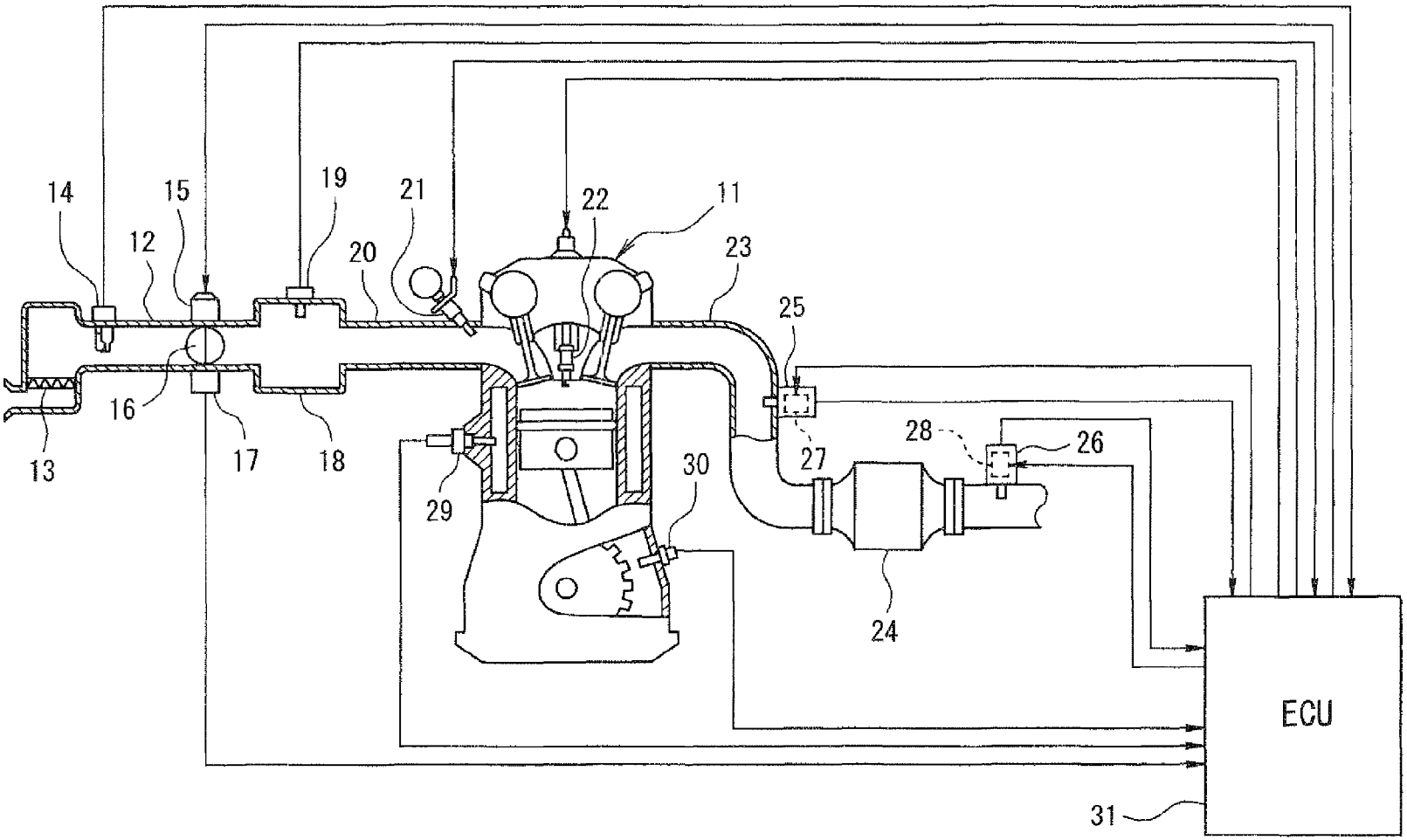
FIG. 1 is a schematic configuration diagram of an entire engine control system common to first to thirteenth embodiments of the present invention.

Referring to FIGS. 1 to 4, a first embodiment will be described hereinafter. FIG. 1 shows an engine control system. An air cleaner 13 is arranged upstream of an intake pipe 12 of an internal combustion engine 11. An airflow meter 14 detecting an intake air flow rate is provided downstream of the air cleaner 13. A throttle valve 16 driven by a DC-motor 15 and a throttle position sensor 17 detecting a throttle position (throttle opening degree) are provided downstream of the air flow meter 14.

A surge tank 18 including an intake air pressure sensor 19 is provided downstream of the throttle valve 16. The intake air pressure sensor 19 detects intake air pressure. An intake manifold 20 which introduces air into each cylinder of the engine 11 is provided downstream of the intake pipe 12, and the fuel injector 21 which injects the fuel is provided at a vicinity of an intake port of the intake manifold 20 of each cylinder. A spark plug 22 is mounted on a cylinder head of the engine 11 corresponding to each cylinder to ignite air-fuel mixture in each cylinder.

An exhaust pipe 23 (exhaust passage) of the engine 11 is provided with a three-way catalyst 24 purifying CO, HC, NOx in the exhaust gas. Exhaust gas sensors 25, 26 such as air-fuel ratio sensors and oxygen sensors are disposed upstream and downstream of the three-way catalyst 24 to detect air-fuel ratio of the exhaust gas. The exhaust gas sensors 25, 26 have heaters 27, 28 respectively, for heating the sensor elements. The exhaust gas sensor 26 on the downstream side may not be provided.

A coolant temperature sensor 29 detecting a coolant temperature, and a crank angle senor 30 outputting a pulse signal every predetermined crank angle of a crankshaft of the engine 11 are disposed on a cylinder block of the engine 11. A crank angle and an engine speed are detected based on the output signal of the crank angle sensor 30.

The outputs of the sensors are inputted to an electronic control unit (ECU) 31. The ECU 31 includes a microcomputer which executes an engine control program stored in a Read Only Memory (ROM) to control a fuel injection quantity of a fuel injector 21 and an ignition timing of a spark plug 22 according to an engine running condition.

The ECU 31 performs a main feedback control for feedback-correcting a fuel injection quantity so that the air-fuel ratio of the exhaust gas upstream of the catalyst 24 coincides with the target air-fuel ratio on the basis of the output of the upstream exhaust gas sensor 25. The ECU 31 performs a sub-feedback control for correcting a feedback correction amount of the target air-fuel ratio upstream of the catalyst 24 or the fuel injection quantity on the basis of an output of the downstream exhaust gas sensor 26, thereby increasing the exhaust gas purification efficiency of the catalyst 24.

The detection precision of the exhaust gas sensors 25, 26 is low until the temperature of the sensor element does not rise to the activation temperature (for example, 750° C.). Consequently, before the air-fuel ratio feedback control (main/sub feedback control) is started after starting period of engine, the heaters 27, 28 of the exhaust gas sensors 25, 26 have to be energized to heat and activate the sensor elements. Therefore, in order to start the air-fuel ratio feedback control early after starting period of engine, the sensor elements of the exhaust gas sensors 25, 26 have to be activated early.

However, water vapor generated by the combustion reaction between the fuel and the air is included in the exhaust gas of the engine 11. When the temperature of the exhaust pipe 23 is low immediately after starting period of the engine 11, the exhaust gas including the water vapor is cooled down in the exhaust pipe 23. In some cases, the water vapor in the exhaust gas in the exhaust pipe 23 is condensed and condensate water is generated. Consequently, there is a possibility that the condensate water generated in the exhaust pipe 23 immediately after starting period of engine adheres to the sensor elements in the exhaust gas sensors 25, 26. When the sensor elements are heated by the heaters 27, 28 immediately after starting period, "element breaking" that the high-temperature sensor elements heated by the heaters 27, 28 are broken due to local cooling (heat distortion) caused by adhesion of the condensate water may occur.

The ECU 31 executes a heater energization delay time control program in FIG. 2 which will be described later. In this heater energization delay time control, an energization of the heaters 27, 28 is inhibited until the elapsed time immediately after starting period of engine reaches the final heater energization delay time. When the elapsed time reaches the final heater energization delay time, the energization of the heaters 27, 28 is started to start heating the sensor elements.

If the final heater energization delay time is established on the basis of only the start conditions such as the coolant temperature during starting period of engine as described in JP-2003-328821A and JP-2007-321561A, the influence of a change in the exhaust heat quantity after starting period cannot be reflected on the final heater energization delay time. In the first embodiment, therefore, the reference heater energization delay time is established according to an engine conditions during starting period, an extension delay time is established according to an engine condition after starting period, and the final heater energization delay time is established by adding the extension delay time to the reference heater energization delay time.

Final heater energization delay time=Reference heater energization delay time+Extension delay time As a result, the final heater energization delay time can be established based on the engine conditions during and after starting period.

It is also possible to establish a correction coefficient for the reference heater energization delay time in accordance with the engine conditions after starting period, and establish the final heater energization delay time by multiplying the reference heater energization delay time by the correction factor.

Final heater energization delay time=Reference heater energization delay time×Correction coefficient The control for the heater energization delay time of the exhaust gas sensors 25, 26 is executed as follows by the ECU 31 in accordance with the heater energization delay time control program in FIG. 2. The heater energization delay time control program shown in FIG. 2 is repetitively executed in predetermined cycles while an ignition switch (not shown) is ON. In step 101, the computer determines whether a shift range of an automatic transmission is a P-range or an N-range (whether the car is being stopped or not). When the shift range is either the P-range or the N-range, the procedure advances to step 102 in which the computer determines whether an energization of the heaters 27, 28 has started. When the energization of the heaters 27, 28 has already started, without performing the following processes, the program is finished.

Figure 3:
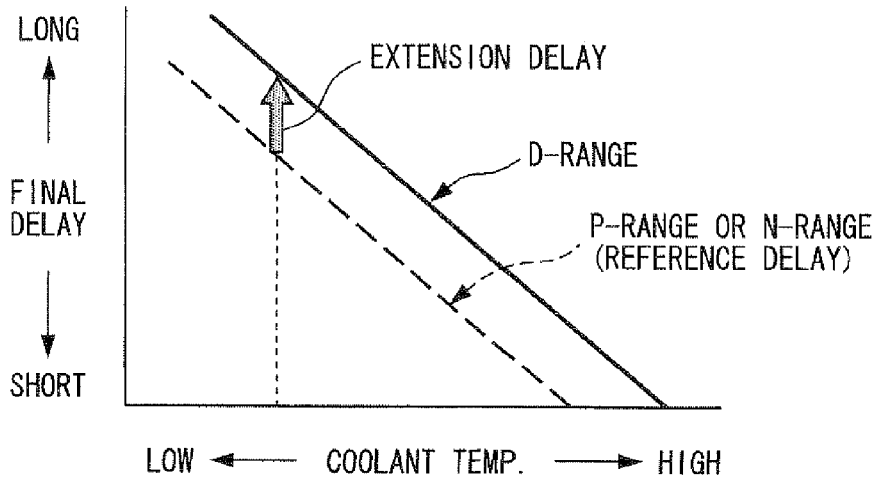
FIG. 3 is a diagram for explaining a method of establishing a final heater energization delay time according to the first embodiment.

When it is determined in the step 102 that the heater energization has not started yet, the procedure advances to step 103 in which the computer determines whether the reference heater energization delay time is established. When the reference heater energization delay time has not established yet, the procedure advances to step 104 in which the reference heater energization delay time is established based on the start condition by use of a map. As the start conditions, for example, a coolant temperature during starting period of engine is used. As shown in FIG. 3, as the coolant temperature is lower during starting period, the reference heater energization delay time is established longer.

The reference heater energization delay time may be established in accordance with the lowest temperature among the coolant temperature, an intake-air temperature, an ambient temperature, and an oil temperature. The reference heater energization delay time may be corrected in accordance with a difference between the coolant temperature during starting period of engine and an ambient temperature (or a difference between a coolant temperature and an intake-air temperature).

The process in step 104 is performed only once during starting period of engine according to the determining process in step 103. The process in step 104 corresponds to a reference heater energization delay time establishing means.

On the other hand, when it is determined in step 101 that the shift range is switched from the P-range or the N-range to the D-range, the procedure advances to step 105 in which an extension delay time corresponding to the D-range is established. When the shift range is switched from the P-range or the N-range to the D-range during warm-up control immediately after starting period, a target idle speed drops and an exhaust heat quantity decreases. In this program, when the shift range is switched to the D-range, the extension delay time is established and the final heater energization delay time is extended.

The extension delay time may be established according to not only the shift range but also at least one of an engine speed, an ignition timing, and an intake air flow rate as the engine condition after starting period. Generally, as the engine speed becomes higher, the exhaust heat quantity increases. When the ignition timing is delayed, the exhaust temperature rises. As the intake air flow rate increases, the exhaust heat amount increases. For example, when the engine speed becomes greater than or equal to a predetermined value, the extension delay time may be shortened. When the ignition timing is delayed by a predetermined amount, the extension delay time may be extended. When the intake air flow rate increases by a predetermined value, the extension delay time may be shortened.

The number of times of establishing (changing) the extension delay time in step 105 may be limited to a predetermined number or less, or only once.

As described above, the reference heater energization delay time is established according to the start conditions in step 104 and the extension delay time is established according to the engine conditions after starting period in step 105. After that, the procedure advances to step 106. By adding the extension delay time to the reference heater energization delay time, the final heater energization delay time is established.

Final heater energization delay time=Reference heater energization delay time+Extension delay time Since the extension delay time establishing process in step 105 is not performed until the shift range is switched to the D-range, the reference heater energization delay time is established as the final heater energization delay time.

Final heater energization delay time=Reference heater energization delay time

The processes in steps 105 and 106 correspond to a delay time correcting means.

After that, the procedure advances to step 107 in which the computer determines whether elapsed time after starting period of engine has reached the final heater energization delay time. When the elapsed time after starting period of engine has not reached the final heater energization delay time, the procedure advances to step 109 in which an energization of the heaters 27, 28 is inhibited. When the elapsed time after starting period of engine reaches the final heater energization delay time, the procedure advances to step 108 and the energization of the heaters 27, 28 is started. The processes in steps 107 to 109 correspond to a heater energization control means The final heater energization delay time of the upstream exhaust gas sensor 25 and that of the downstream exhaust gas sensor 26 may be established independently from each other.

Figure 4:
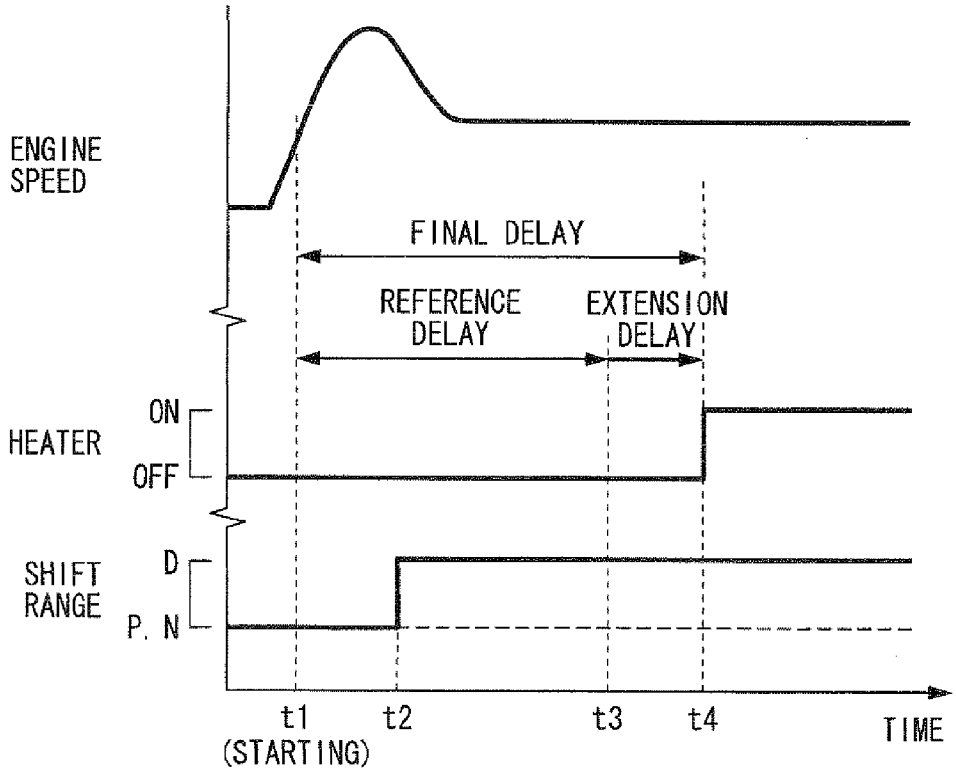
FIG. 4 is a time chart showing a control of the final heater energization delay time according to the first embodiment.

Referring to FIG. 4, a control of the final heater energization delay time will be described. The computer determines that the engine is started at time t1. The reference heater energization delay time is established in accordance with the start conditions of the engine at time t1. When the shift range is switched from the P-range or the N-range to the D-range before the elapsed time after starting period of engine reaches the reference heater energization delay time (before t3), the extension delay time corresponding to the D-range is established at time t2, and the final heater energization delay time is obtained by adding the extension delay time to the reference heater energization delay time. After that, when the elapsed time after starting period of engine reaches the final heater energization delay time at time t4, the energization of the heaters 27, 28 is started.

When the shift range is not switched to the D-range before the elapsed time after starting period of engine reaches the reference heater energization delay time (before t3) and continuous time of the P-range or the N-range exceeds the reference heater energization delay time, the reference heater energization delay time becomes the final heater energization delay time. When the elapsed time after starting period reaches the reference heater energization delay time (final heater energization delay time) at time t3, the energization of the heaters 27, 28 is started.

According to the first embodiment, the reference heater energization delay time is established based on the engine condition during starting period, the extension delay time is established based on the engine condition after starting period, and the final heater energization delay time is established by adding the extension delay time to the reference heater energization delay time. Consequently, the final heater energization delay time can be established based on the engine condition during starting period and the engine condition after starting period. Consequently, corresponding to a change in time necessary for increasing the temperature in the exhaust pipe 23 after starting period of the engine 11 up to a temperature at which no condensate water is generated, the heater energization delay time can be corrected to proper time after starting period of engine in order to prevent an element breaking of the exhaust gas sensors 25, 26. The precision of the heater energization delay time can be increased by a relatively simple process, and both early activation of the exhaust gas sensors 25, 26 and the element breaking prevention can be realized.

[Second Embodiment]

Figure 5:
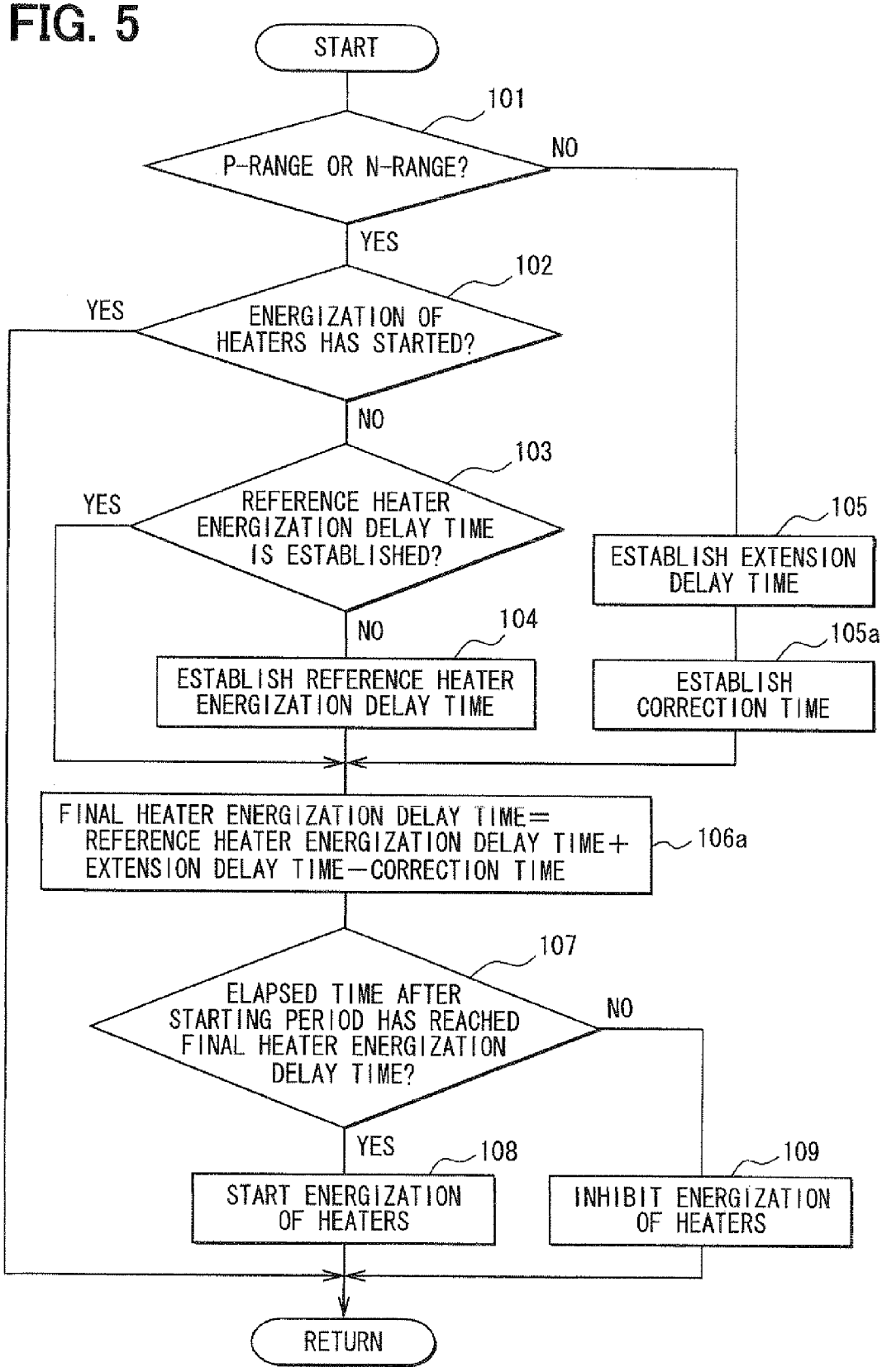
FIG. 5 is a flowchart showing a heater energization delay time control according to a second embodiment.
Figure 6:
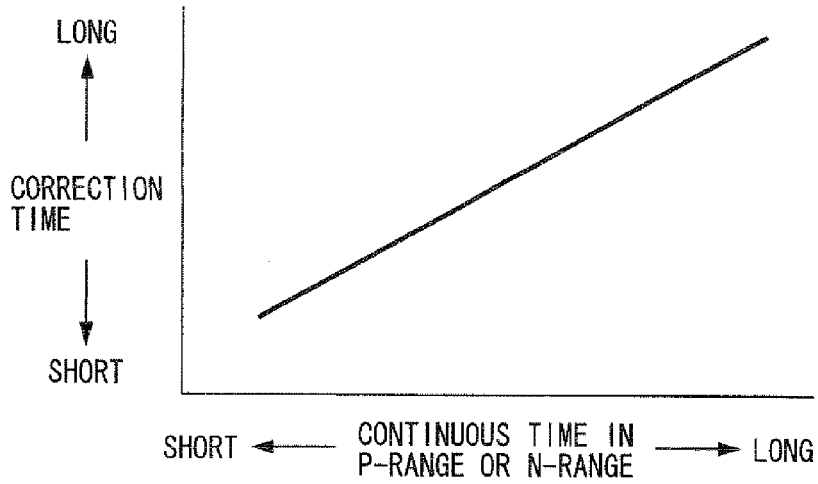
FIG. 6 is a diagram conceptually showing a map for establishing a correction time according to the second embodiment.
Figure 7:
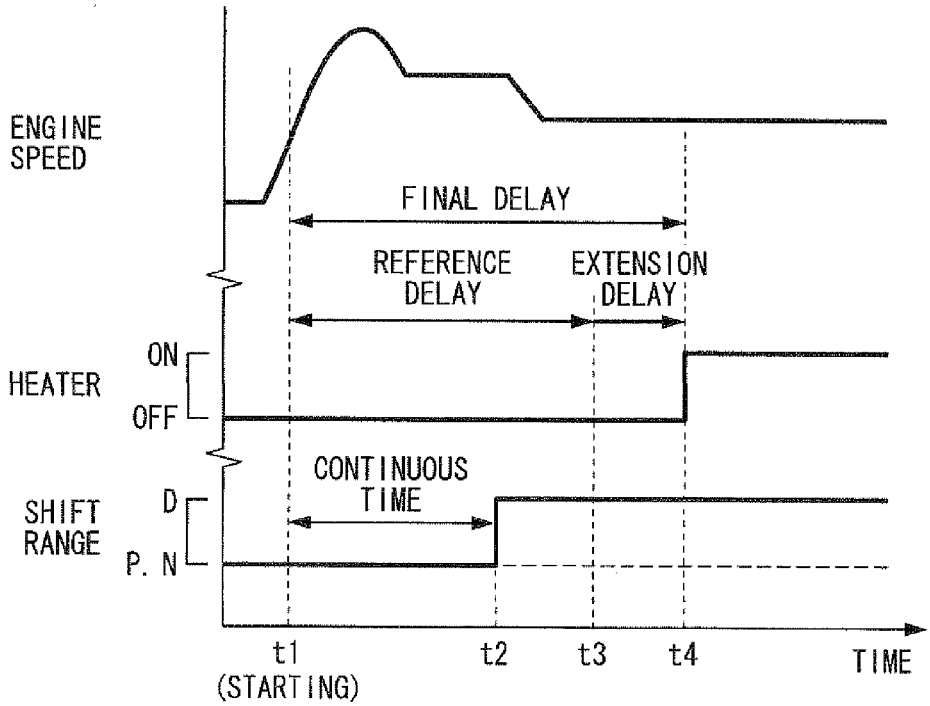
FIG. 7 is a time chart showing a final heater energization delay time control according to the second embodiment.

In a second embodiment of the present invention shown in FIGS. 5 to 7, a correction time for extension delay time is established in accordance with elapsed time after starting period of engine until the engine conditions change in order to correct the final heater energization delay time. The other configurations are the same as those of the first embodiment.

In a heater energization delay time control shown in FIG. 5, a process of step 105*a* is added after the process of step 105. A process of the step 106 in FIG. 2 is changed to a process of step 106*a*. The processes of the other steps are the same as those of the steps in FIG. 2.

As shown in FIG. 7, in a similar manner to the first embodiment, the reference heater energization delay time is established based on the start conditions at time t1. After that, the continuous time of the P-range or the N-range until the range is switched to the D-range from the P-range or the N-range after starting period of engine is measured. When the range is switched to the D-range at time t2, the extension delay time corresponding to the D-range is established (step 105). A correction time according to the continuous time of the P-range or the N-range is established with reference to the map of FIG. 6 (step 105*a*). The final heater energization delay time is established by adding a time obtained by subtracting the correction time from the extension delay time to the reference heater energization delay time (step 106*a*).

Final heater energization delay time=Reference heater energization delay time+Extension delay time−Correction time A map for establishing the correction time of FIG. 6 is established so that as the continuous time in the P-range or the N-range becomes longer, the correction time becomes longer and the final heater energization delay time (extension delay time) becomes shorter. After that, when the elapsed time after starting period of engine reaches the final heater energization delay time at time t4, the energization of the heaters 27, 28 is started.

The extension delay time may be established by use of a map based on the engine conditions after starting period and the continuous time in the P-range or the N-range. In this case, the process of establishing correction time is unnecessary.

Also in the second embodiment, the extension delay time and the correction time may be established according to, as the engine conditions after starting period, not only the shift range but also at least one of the engine speed, the ignition timing, and the intake air flow rate.

In the above described second embodiment, the final heater energization delay time is corrected according to elapsed time until the engine condition changes after starting period. Thus, the final heater energization delay time can be established more precisely.

In the first and second embodiments, when the shift range is switched from the D-range to the P-range or the N-range before the elapsed time after starting period of engine reaches the final heater energization delay time, the answer in step 101 is Yes so that the extension delay establishing process in the step 105 is not performed. As a result, also after the shift range is switched to the P-range or the N-range, the final heater energization delay time can be established by use of the extension delay time which is established in the D-range (steps 106 and 106*a*). Therefore, in a case of changing the final heater energization delay time (extension delay time) according to the switching of the shift range, only a change in the extension direction can be permitted to prevent the element breaking of the exhaust gas sensors 25, 26.

[Third Embodiment]

Figure 8:
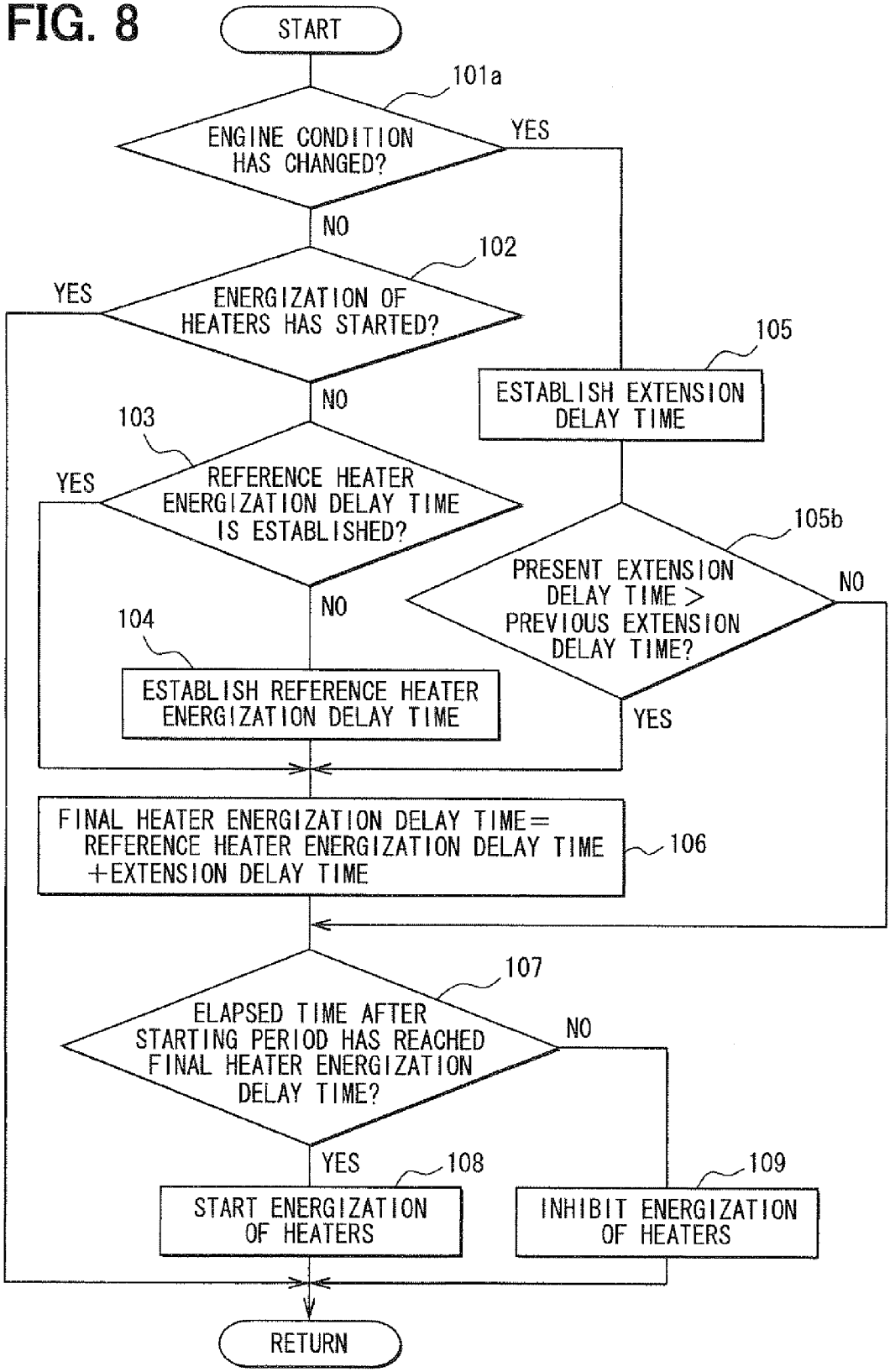
FIG. 8 is a flowchart showing a heater energization delay time control according to a third embodiment.
Figure 9:
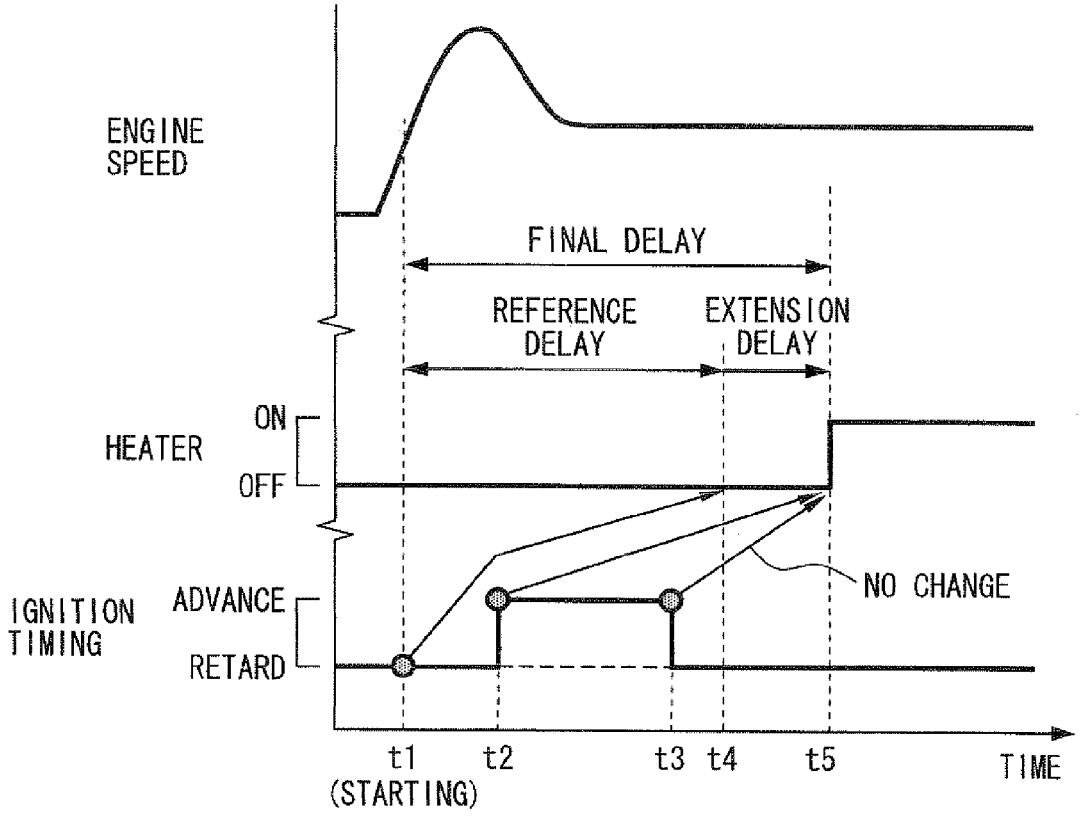
FIG. 9 is a time chart showing a final heater energization delay time control according to a third embodiment.

In a third embodiment shown in FIGS. 8 and 9, in a case of changing the final heater energization delay time (extension delay time) in accordance with the a change in the engine condition after the final heater energization delay time (extension delay time) has established, only a change in the extension direction is permitted. The other configurations are the same as those of the first embodiment.

Figure 2:
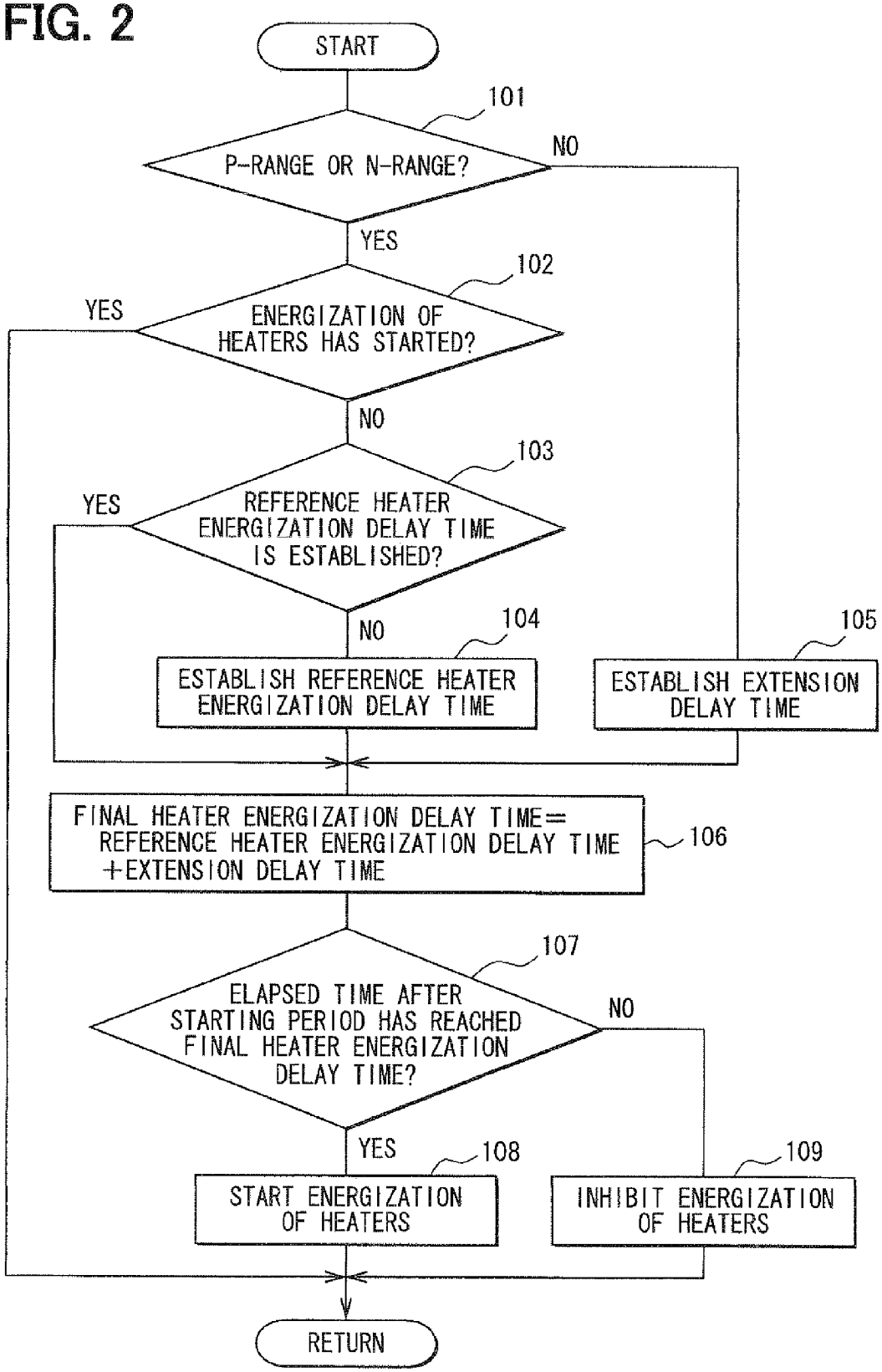
FIG. 2 is a flowchart showing a heater energization delay time control according to a first embodiment.

In a heater energization delay time control shown in FIG. 8, a process in step 101*a* is performed in place of the process in step 101 in FIG. 2 described in the first embodiment. A determination process in step 105*b* is performed after step 105. According to the answer in step 105*b*, the procedure advances to a process in step 106 or 107. The processes of the other steps are the same as the first embodiment.

In step 101*a*, the computer determines whether the engine condition has changed. The engine condition includes at least one of the shift range, the engine speed, the ignition timing, and the intake air flow rate.

During starting period of engine, the computer determines in step 101*a* that the engine condition has not changed. Consequently, the processes in steps 102 to 104 are executed, and the reference heater energization delay time is established according to the engine condition during starting period. Since the process of establishing the extension delay time in step 105 is not performed until the engine condition changes after starting period, the reference heater energization delay time becomes the final heater energization delay time (step 106).

After that, when the engine condition is changed, the answer in step 101*a* becomes Yes. The procedure advances to step 105 where the extension delay time is established according to the engine condition during starting period. After that, the procedure advances to step 105*b* in which the computer determines whether the present extension delay time is longer than the previous extension delay time. In a case of establishing the extension delay time for the first time, since the previous extension delay time is an initial value of "0", the answer in step 105*b* is Yes. The procedure advances to step 106 in which the final heater energization delay time is established by adding the extension delay time to the reference heater energization delay time.

In a case where the establishing of the extension delay time is the second time or more, when it is determined in the step 105*b* that the extension delay time of this time is longer than that of last time, the procedure advances to step 106 in which the final heater energization delay time is established by adding the current extension delay time to the reference heater energization delay time. However, when it is determined in the step 105*b* that the current extension delay time is less than or equal to the previous extension delay time, the process of establishing the final heater energization delay time in step 106 is not performed. The previous final heater energization delay time is maintained.

Referring to FIG. 9, the final heater energization delay time control according to the third embodiment will be described.

The reference heater energization delay time is established in accordance with the engine condition during starting period at time t1. When the engine condition changes (for example, an ignition timing is advanced by a predetermined value or more) before the elapsed time after starting period reaches the reference heater energization delay time (before t4), the extension delay time according to the engine condition is established at time t2, and the final heater energization delay time is established by adding the extension delay time to the reference heater energization delay time.

After that, when the engine condition is changed (for example, the ignition timing is retarded by a predetermined value or more) before the elapsed time after starting period of engine reaches the final heater energization delay time (before t5), the extension delay time according to the engine condition is established at time t3. At this moment, the current extension delay time is compared with the previous extension delay time. When it is determined that the current extension delay time is less than or equal to the previous extension delay time, the current extension delay time is made invalid, the previous final heater energization delay time (the previous extension delay time) is maintained. The final heater energization delay time is not shortened.

According to the above described third embodiment, in the case of changing the final heater energization delay time (extension delay time) in accordance with a change in the engine condition after the final heater energization delay time (extension delay time) is established, only a change in the extension direction on the safe side for the element breaking prevention of the exhaust gas sensors 25, 26 is permitted. Therefore, element breaking of the exhaust gas sensors 25, 26 can be prevented.

In the first to third embodiments, after the elapsed time after starting period of engine exceeds the reference heater energization delay time, even if the engine condition (shift range or the like) changes, the final heater energization delay time (extension delay time) may not be changed.

[Fourth Embodiment]

Figure 10:
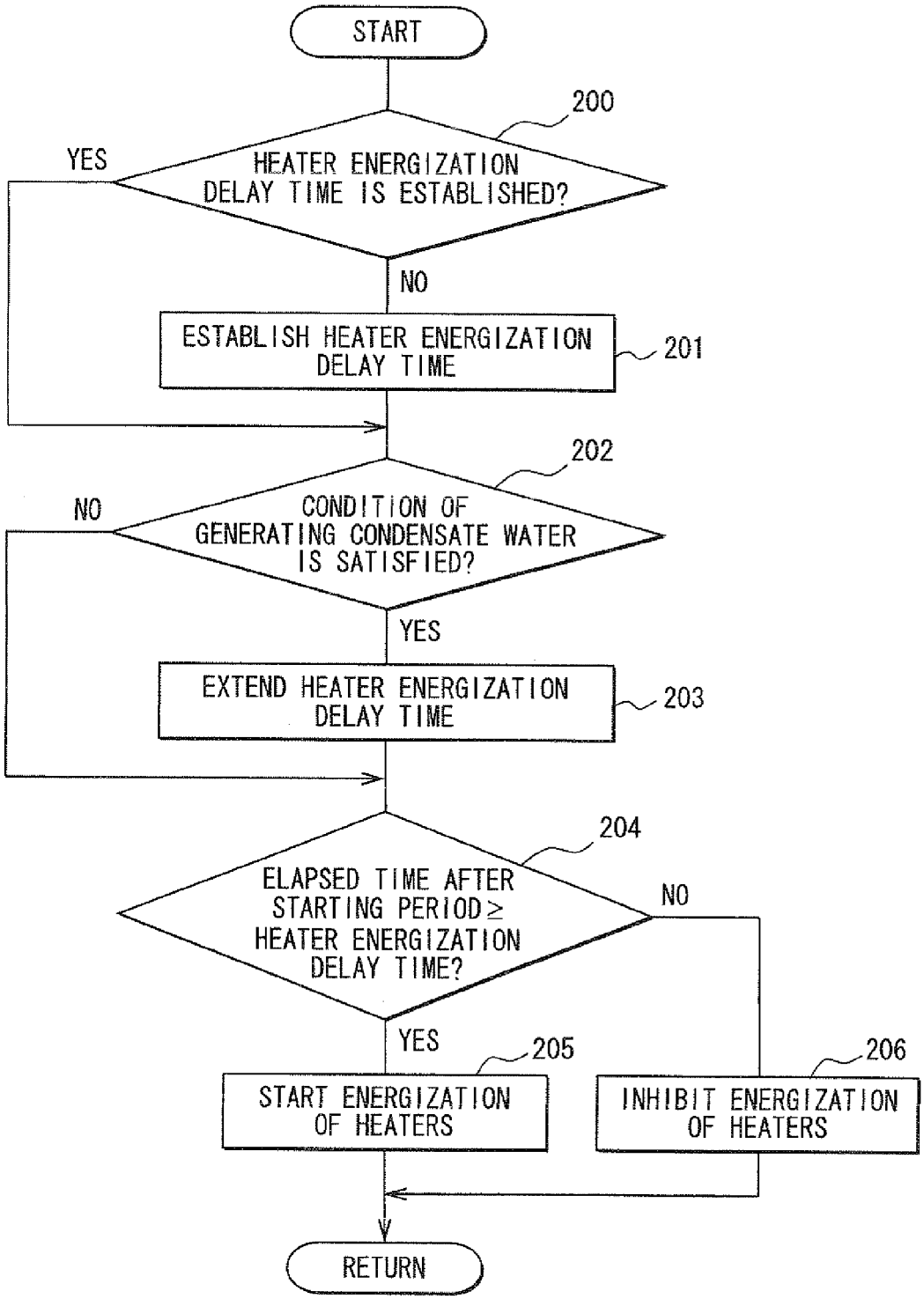
FIG. 10 is a flowchart showing a heater energization delay time control according to a fourth embodiment.

In a fourth embodiment, a heater energization delay time control shown in FIG. 10 is executed in predetermined cycles by the ECU 31 while the ignition switch is ON. The heater energization delay time until starting of energization of the heaters 27, 28 is established according to the engine condition during starting period. After starting period of engine, when it is determined that a condition of generating condensate water in the exhaust pipe 23 is satisfied, the heater energization delay time is extended.

In step 200, the computer determines whether the heater energization delay time is established. If the heater energization delay time is not established yet, the procedure advances to step 201 in which the heater energization delay time is established with reference to a map in accordance with the engine conditions during starting period (a coolant water temperature, an intake-air temperature, an ambient temperature, an oil temperature, and the like). The process in step 201 is performed only once at starting period of engine. The process in step 201 corresponds to the heater energization delay time establishing means.

After that, in step 202, the computer determines whether a condition of generating condensate water in the exhaust pipe 23 is satisfied after starting period of engine based on the engine condition or the like. When the condition of generating condensate water is satisfied, the procedure advances to step 203 in which the heater energization delay time is extended. When the condition of generating condensate water is not satisfied, the heater energization delay time is not extended. The processes in steps 202 and 203 correspond to a delay time correcting means.

After that, in step 204, the computer determines whether elapsed time after starting period of engine has reached the heater energization delay time. When the elapsed time after starting period of engine has not reached the heater energization delay time, the procedure advances to step 206 in which the energization of the heaters 27, 28 is inhibited. When the elapsed time after starting period of engine reaches the heater energization delay time, the procedure advances to step 205 in which the energization of the heaters 27, 28 is started. The processes in steps 204 to 206 correspond to a heater energization control means.

According to the fourth embodiment described above, when it is determined that the condition of generating condensate water in the exhaust pipe 23 is satisfied after starting period of engine, the heater energization delay time is extended. Therefore, the energization of the heaters 27, 28 can be stopped in a period in which the condition of generating the condensate water in the exhaust pipe 23 is satisfied. The element breaking of the exhaust gas sensors 25, 26 can be prevented more reliably.

[Fifth Embodiment]

Figure 11:
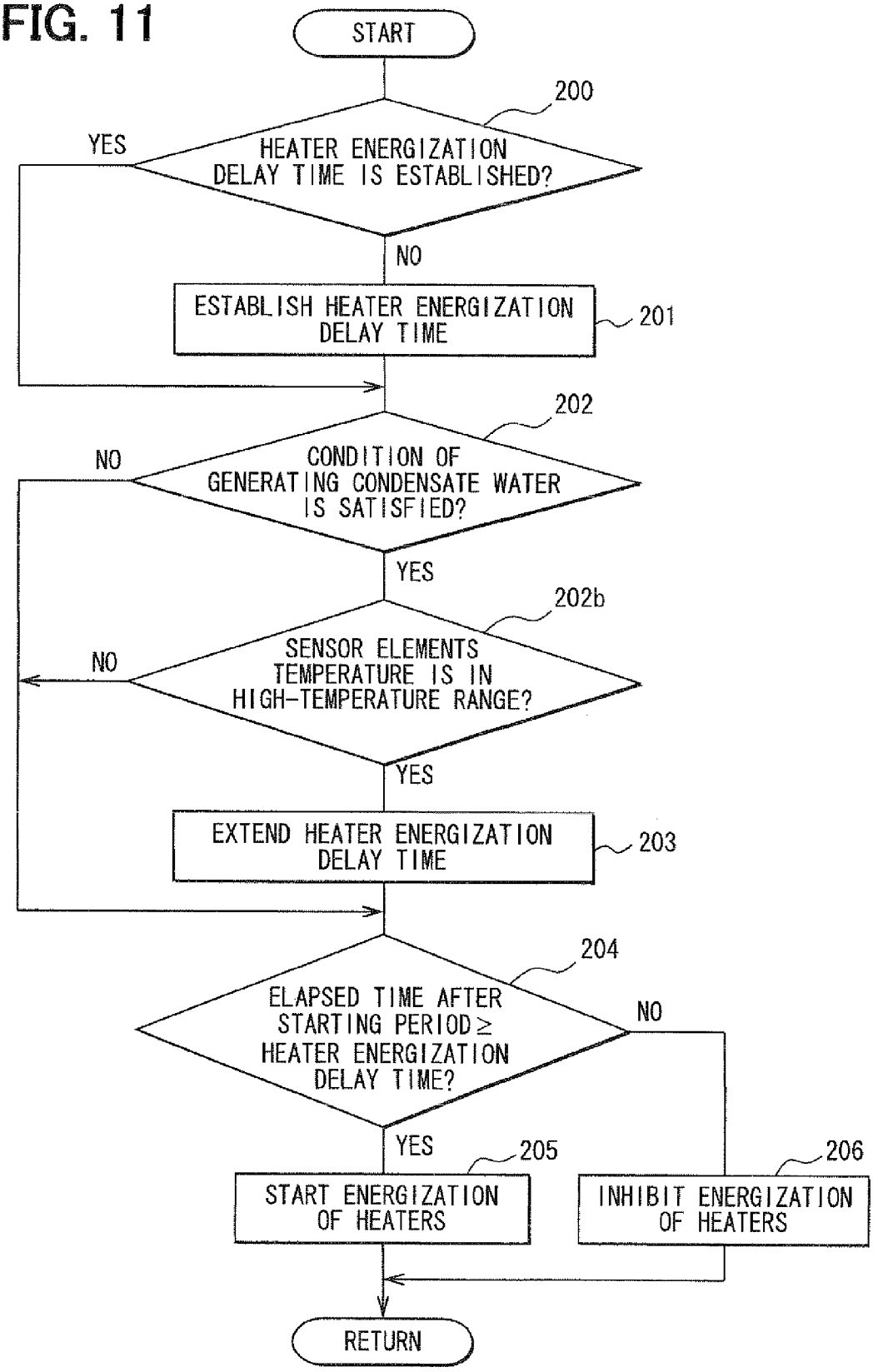
FIG. 11 is a flowchart showing a heater energization delay time control according to a fifth embodiment.

In a fifth embodiment, a heater energization delay time control shown in FIG. 11 is executed. The heater energization delay time control program shown in FIG. 11 is obtained by adding a determining process in step 202*b* after step 202 of the heater energization delay time control program shown in FIG. 10. The processes of the other steps are the same as those in steps in FIG. 10.

When the computer determines in step 202 that a condition of generating condensate water in the exhaust pipe 23 after starting period of engine is satisfied, the procedure advances to step 202*b* in which the computer determines whether the temperature of the sensor elements of the exhaust gas sensors 25, 26 has increased to a high-temperature range in which an element breaking may occur due to water adhesion. When it is determined that the temperature has risen to the high-temperature range, the heater energization delay time is extended. In this case, even when the condition of generating condensate water is satisfied, if the temperature of the sensor elements of the exhaust gas sensors 25, 26 has not risen to the high-temperature range in which an element breaking may occur due to water adhesion, the heater energization delay time is not extended.

According to the fifth embodiment described above, even when the condition of generating condensate water is satisfied, if there is no possibility of occurrence of element breaking in the exhaust gas sensors 25, 26, the heater energization delay time is not extended. There is consequently an advantage that the number of times of extending the heater energization delay time can be decreased.

Alternatively, when it is determined that the condition of generating condensate water is satisfied and the temperature of the sensor elements of the exhaust gas sensors 25, 26 has risen to the high-temperature range in which element breaking due to water adhesion may occur, the engine operating condition may be controlled so as to suppress generation/splash of condensate water.

[Sixth Embodiment]

Figure 12:
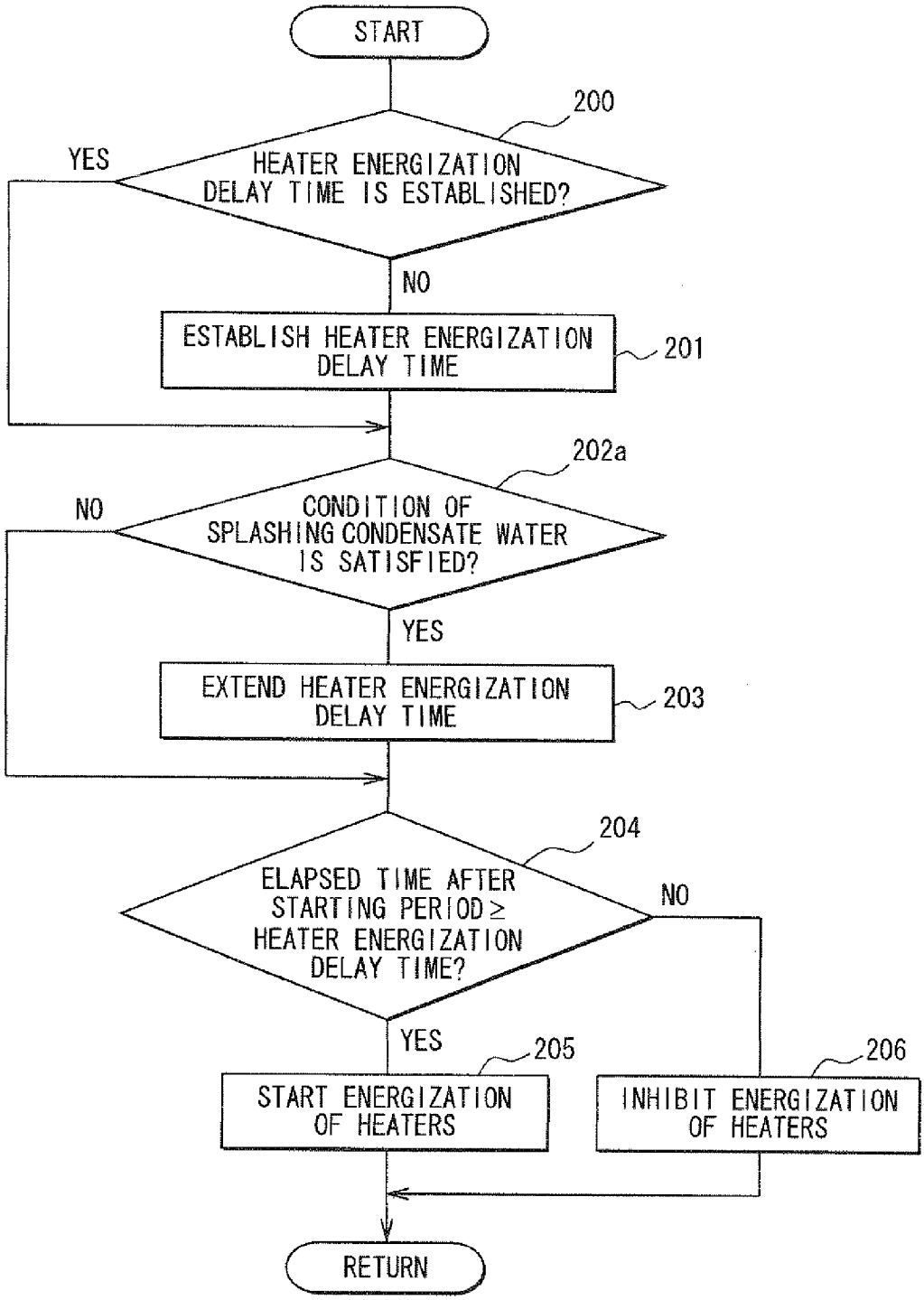
FIG. 12 is a flowchart showing a heater energization delay time control according to a sixth embodiment.

In a sixth embodiment, a heater energization delay time control program shown in FIG. 12 is executed. The heater energization delay time control shown in FIG. 12 is obtained by changing the process in step 202 shown in FIG. 10 to a process in step 202*a*. The other steps are the same as steps in FIG. 10.

In the heater energization delay time control shown in FIG. 12, the heater energization delay time is established in accordance with the engine condition during starting period in step 201. After that, the procedure advances to step 202*a* in which the computer determines whether a condition of splashing condensate water generated in the exhaust pipe 23 is satisfied on the basis of the engine condition and the like. If the condition of splashing condensate water is satisfied, the procedure advances to step 203 in which the heater energization delay time is extended. If the condition of generating condensate water is not satisfied, the heater energization delay time is not extended.

According to the sixth embodiment described above, when the computer determines that the condition of splash condensate water is satisfied, the heater energization delay time is extended. Consequently, energization of the heaters 27, 28 can be stopped reliably in the period in which the condition of generating condense water in the exhaust pipe 23 is satisfied. Therefore, an element breaking of the exhaust gas sensors 25, 26 can be prevented more reliably.

[Seventh Embodiment]

Figure 13:
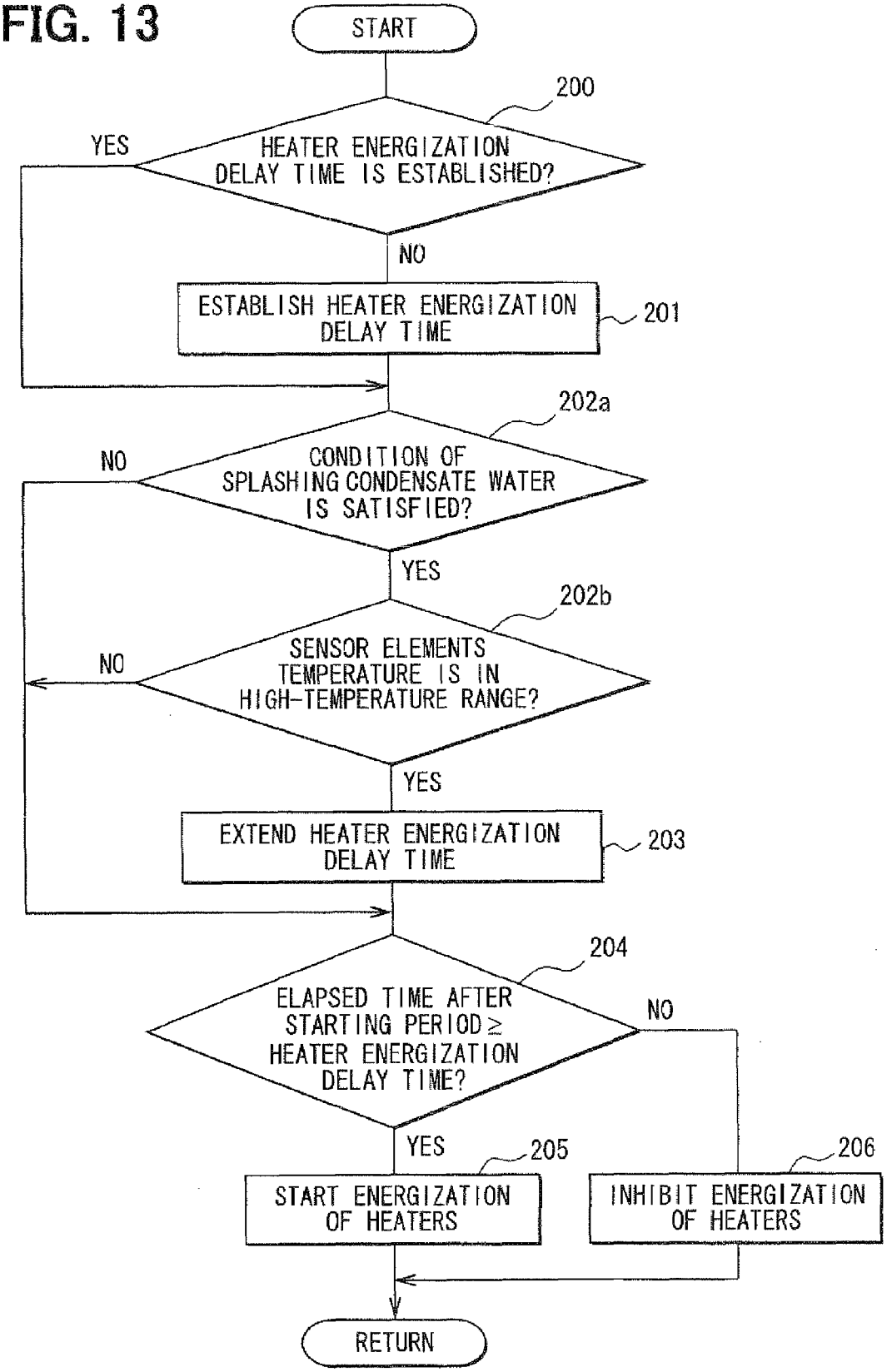
FIG. 13 is a flowchart showing a heater energization delay time control according to a seventh embodiment.

In a seventh embodiment, a heater energization delay time control shown in FIG. 13 is executed. The heater energization delay time control shown in FIG. 13 is obtained by adding a determining process in step 202*b* after step 202*a* of the heater energization delay time control shown in FIG. 12. The processes of the other steps are the same as those in the steps in FIG. 12.

When the computer determines that a condition of splashing condensate water in the exhaust pipe 23 after starting period of engine is satisfied in step 202*a*, the procedure advances to step 202*b* in which the computer determines whether the temperature of the sensor elements of the exhaust gas sensors 25, 26 has risen to a high-temperature range in which an element breaking may occur due to water adhesion. When it is determined that the temperature has risen to the high-temperature range, the heater energization delay time is extended. In this case, even when the condition of splashing condensate water is satisfied, if the temperature of the sensor elements of the exhaust gas sensors 25, 26 has not risen to the high-temperature range in which an element breaking may occur due to water adhesion, the heater energization delay time is not extended.

According to the seventh embodiment described above, even when the condition of splashing condensate water is satisfied, if there is no possibility of occurrence of element breaking in the exhaust gas sensors 25, 26, the heater energization delay time is not extended. Thus, the number of times of extending the heater energization delay time can be decreased.

Alternatively, when it is determined that the condition of splashing condensate water is satisfied and the temperature of the sensor elements of the exhaust gas sensors 25, 26 has risen to the high-temperature range in which element breaking due to water adhesion may occur, the engine operating condition may be controlled so as to suppress generation/splash of condensate water.

[Eighth Embodiment]

Figure 14:
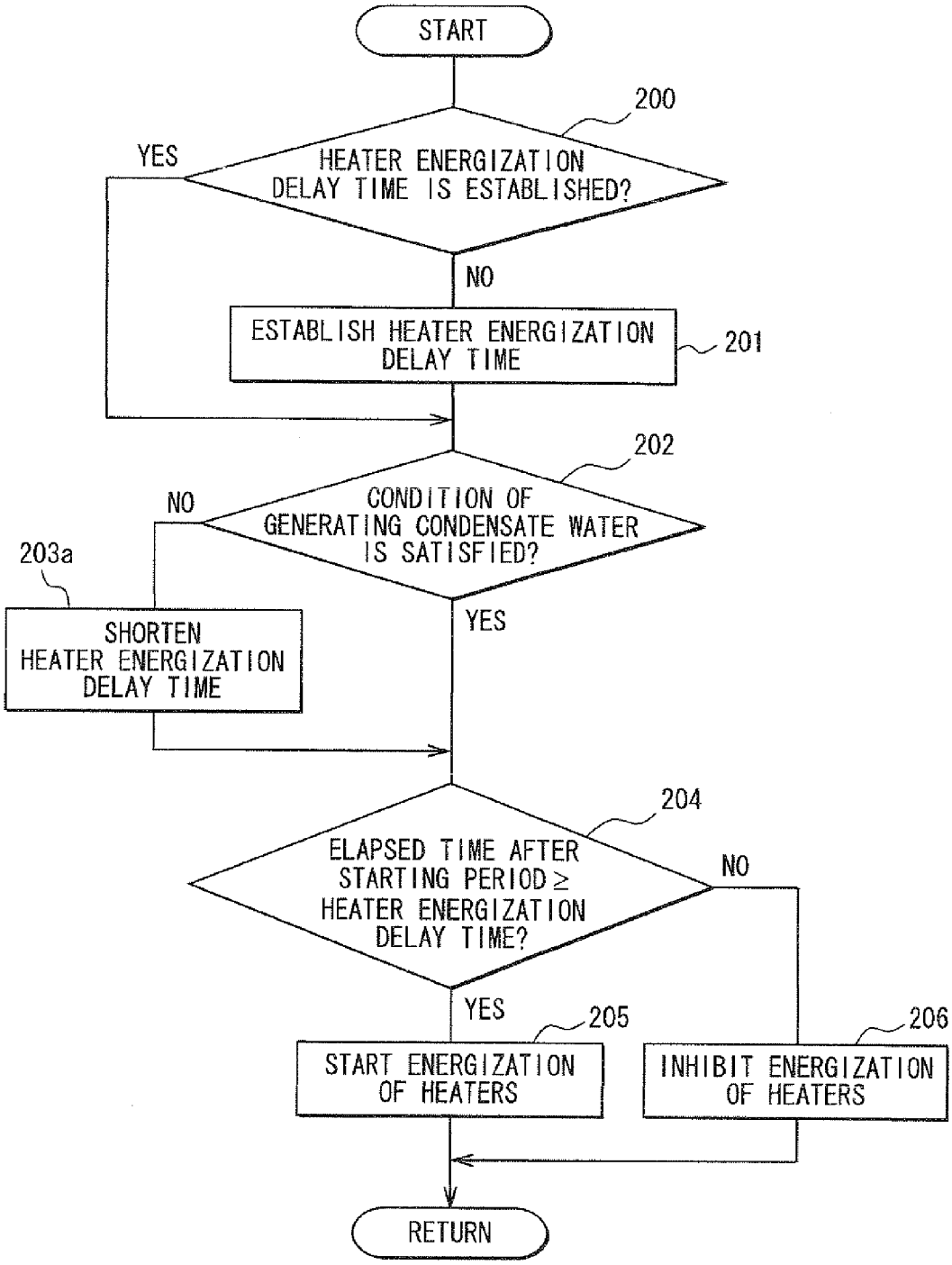
FIG. 14 is a flowchart showing a heater energization delay time control according to an eighth embodiment.

In an eighth embodiment, a heater energization delay time control shown in FIG. 14 is executed. The heater energization delay time control shown in FIG. 14 is obtained by eliminating the process in step 203 in FIG. 10, and adding a process in step 203*a* executed when the answer is No in step 202. The processes of the other steps are the same as those of FIG. 10.

In step 201, according to the engine condition during starting period, a heater energization delay time is established to be longer than the time of the fourth embodiment. That is, the heater energization delay time is established as a time in which element breaking in the exhaust gas sensors 25, 26 can be prevented even if the condition of generating condensate water in the exhaust pipe 23 is satisfied. After that, the procedure advances to step 202 in which the computer determines whether the condition of generating condensate water in the exhaust pipe 23 after starting period of engine is satisfied. When the computer determines that the condition of generating the condense water is satisfied, the heater energization delay time is not changed. However, when the computer determines that the condition of generating the condense water in the exhaust pipe 23 is not satisfied (that is, when it is determined that condense water is not generated), the procedure advances to step 203*a* in which the heater energization delay time is shortened.

Thus, the heater energization delay time can be shortened in the range where an element breaking in the exhaust gas sensors 25, 26 can be prevented An early activation of the exhaust gas sensors 25, 26 can be realized,

[Ninth Embodiment]

Figure 15:
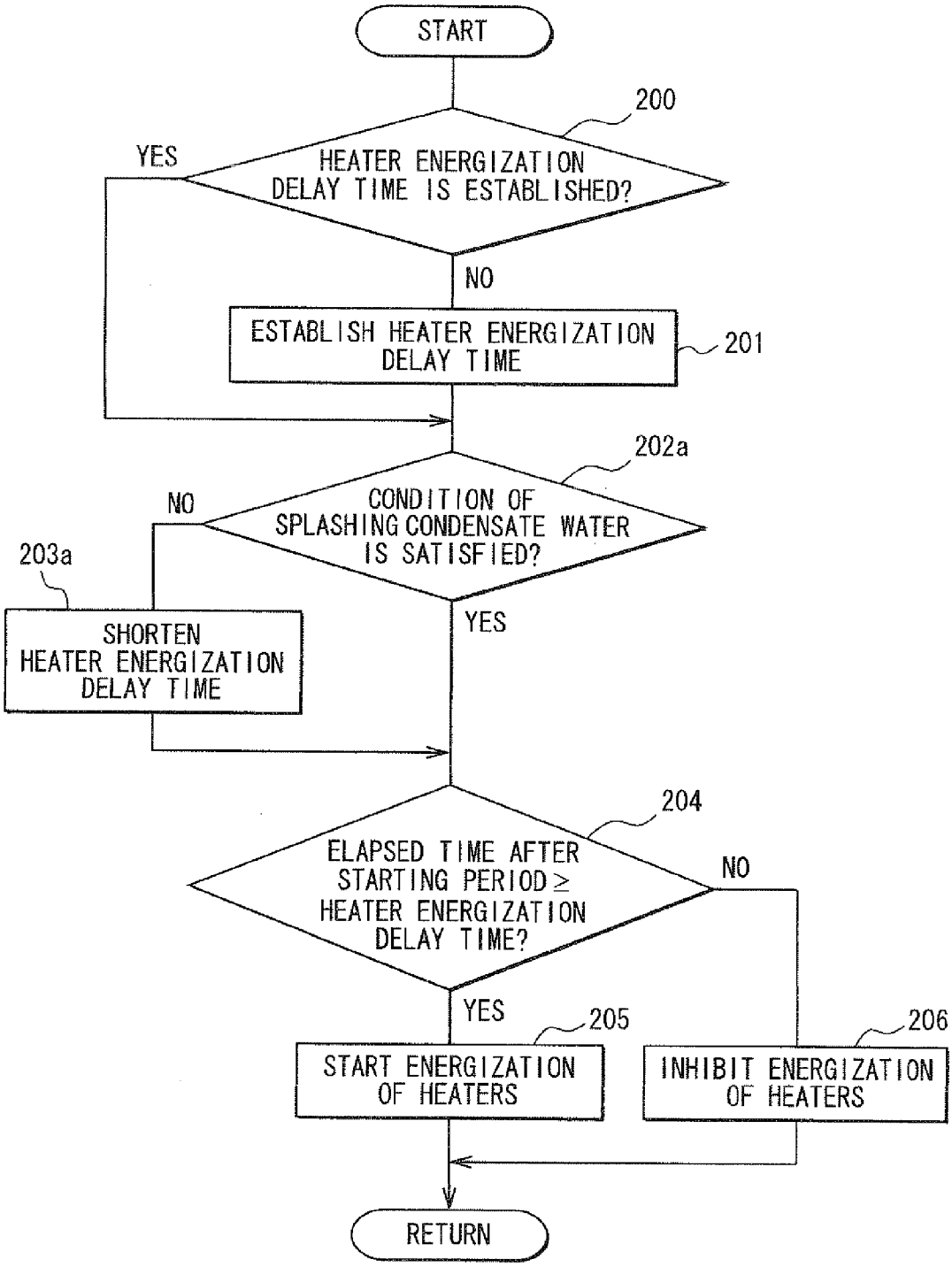
FIG. 15 is a flowchart showing a heater energization delay time control according to a ninth embodiment.

In a ninth embodiment, a heater energization delay time control shown in FIG. 15 is executed. The heater energization delay time control shown in FIG. 15 is obtained by eliminating the process of step 203 executed when the answer is Yes in the step 202*a* in FIG. 12, and by adding a process of step 203*a* executed when the answer is No in the step 202*a*. The processes of the other steps are the same as those of FIG. 10.

In step 201, according to the engine condition during starting period, a heater energization delay time is established to be longer than the time of the sixth embodiment. That is, the heater energization delay time is established as a time in which an element breaking in the exhaust gas sensors 25, 26 can be prevented even if the condition of splashing condensate water generated in the exhaust pipe 23 is satisfied. After that, the procedure advances to step 202*a* in which a computer determines whether the condition of splashing condensate water in the exhaust pipe 23 after starting period of engine is satisfied. When the computer determines that the condition of splashing the condensate water is satisfied, the heater energization delay time is not changed. However, when the computer determines that the condition of splashing the condense water is not satisfied (that is, when it is determined that condense water is not splashed), the procedure advances to step 203*a* in which the heater energization delay time is shortened.

Thus, the heater energization delay time can be shortened in the range where an element breaking in the exhaust gas sensors 25, 26 can be prevented. An early activation of the exhaust gas sensors 25, 26 can be realized.

[Tenth Embodiment]

The ECU 31 establishes a preheat period in accordance with an engine condition during starting period by executing a heater energization control shown in FIG. 16 which will be described later. Until the preheat period elapses after starting period of engine, the ECU 31 executes a preheat control in which an energization duty of the heaters 27, 28 is regulated so as to preheat the sensor elements of the exhaust gas sensors 25, 26 at a temperature at which no element breaking occurs due to water adhesion. The energization duty of the heaters 27, 28 is referred to as a heater energization duty, hereinafter. After the preheat period elapsed, the ECU 31 increases the heater energization duty to increase the temperature of the sensors 25, 26 to the activation temperature. The ECU 31 executes activation control of controlling the heater energization duty so that the sensor elements are maintained in the active state.

In this case, if the heater energization duty during the preheat period is established according to only the engine condition during starting period of engine in a conventional manner, a change in the exhaust heat amount caused by a change in the engine condition during the preheat period cannot be reflected in the preheat control. Thus, the preheat temperature of the sensor element changes according to the change in the exhaust heat quantity caused by a change in engine condition during the preheat period.

Figure 20:
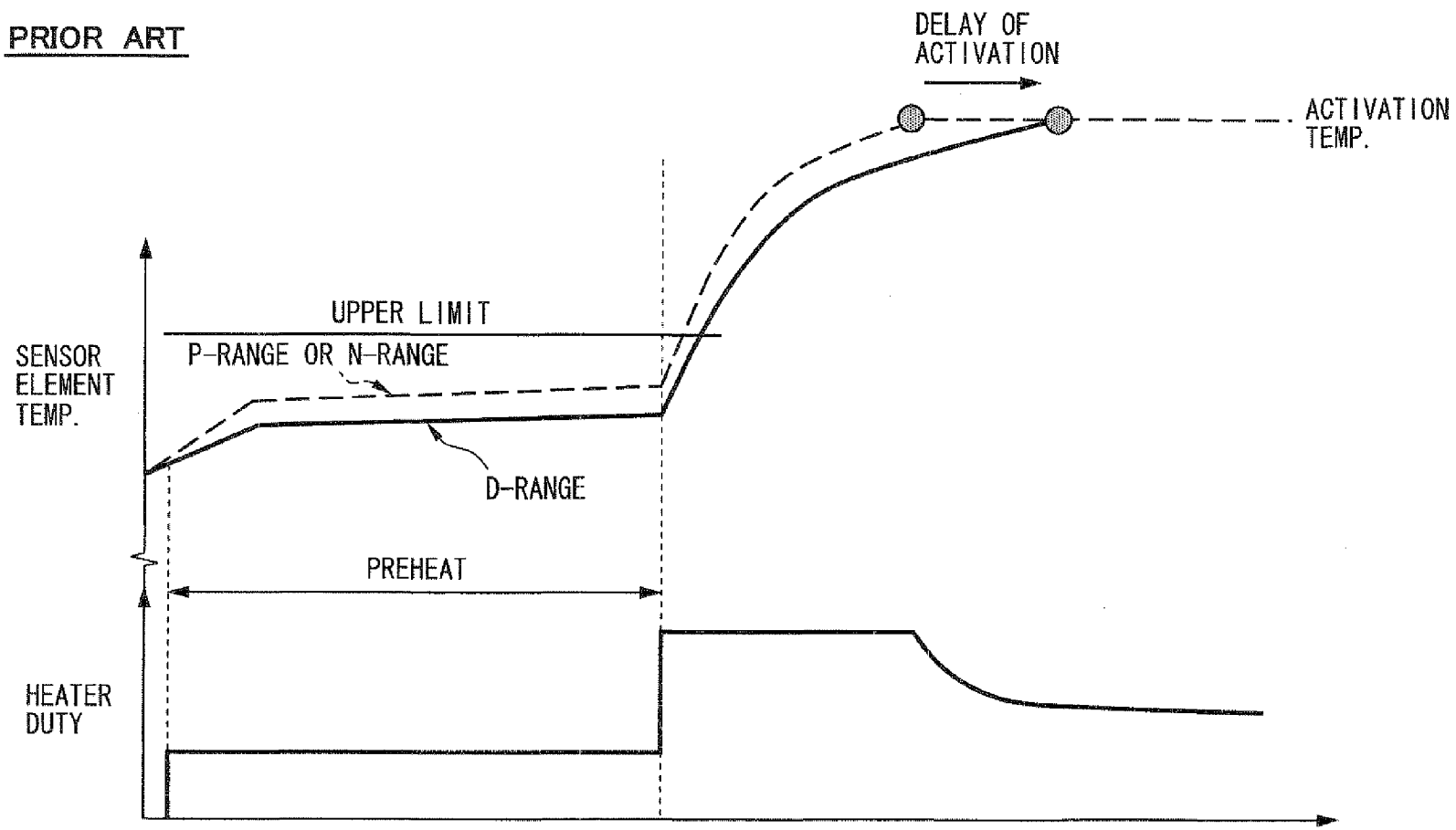
FIG. 20 PRIOR ART
FIG. 20 is a time chart for explaining problems of conventional preheat control.

Since the catalyst 24 is not activated during the preheat period of the exhaust gas sensors 25, 26, the catalyst early warm-up control is executed. In the case where the shift range is the P-range or the N-range, when the target idle speed is established to a speed (for example, 1,250 rpm) higher than the normal speed and the shift range is switched to the D-range, the target idle speed drops to a lower target speed (for example, 900 rpm). Consequently, when the shift range is switched from the P-range or the N-range to the D-range during the preheat period, the target idle speed drops, and the exhaust heat amount decrease. As shown in FIG. 20, in the conventional control apparatus, when the engine is operated in the D-range during the preheat period, the preheat temperature of the sensor element drops more than a case where the engine is operated in the P-range or the N-range. A time required to increase the sensor element temperature to the activation temperature after completion of the preheat period becomes long. A start of the air-fuel ratio feedback control delays and the exhaust emission deteriorates.

Figure 16:
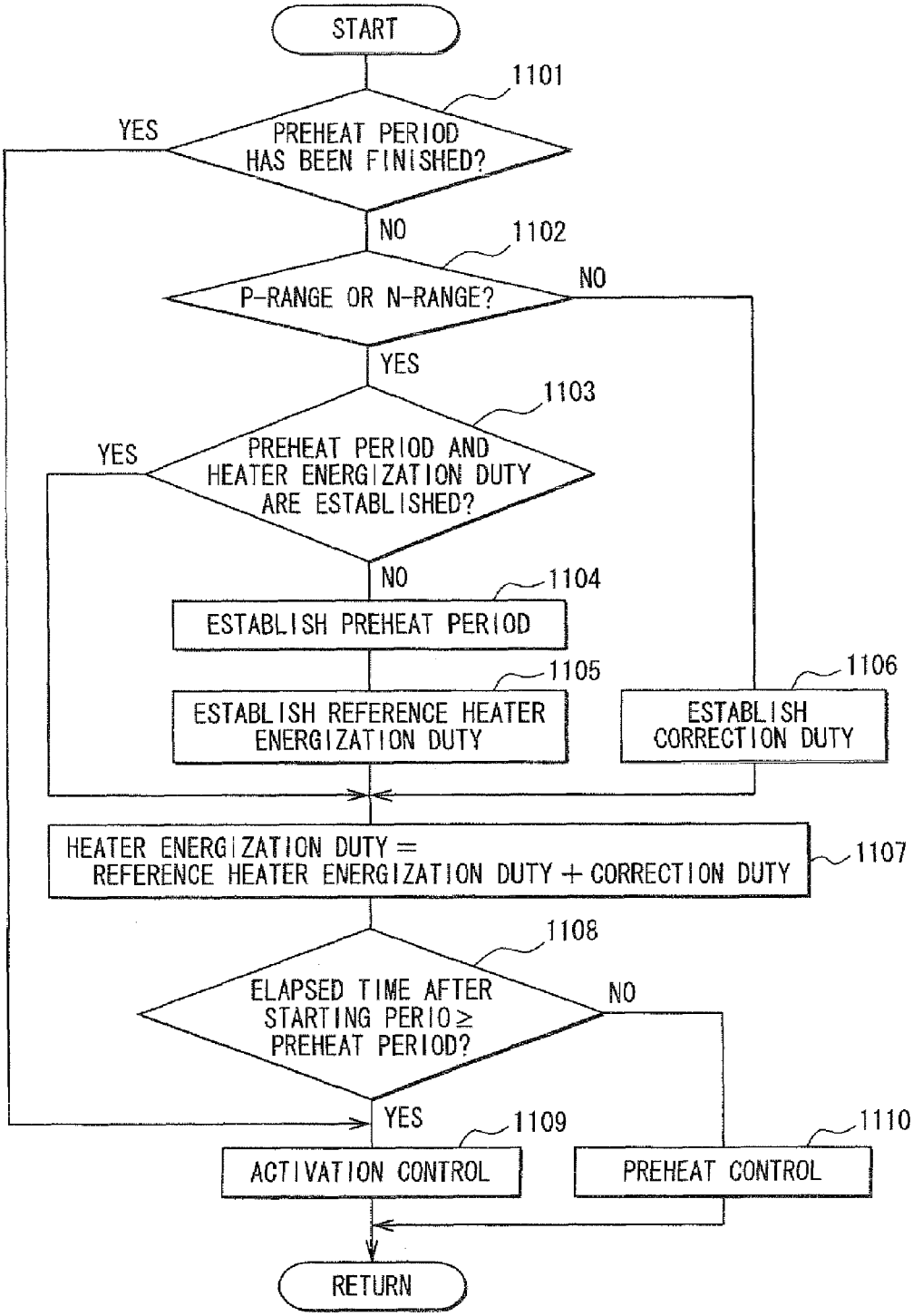
FIG. 16 is a flowchart showing a heater energization control according to a tenth embodiment.

In order to solve the above problems, the ECU 31 executes the heater energization control shown in FIG. 16 to correct the heater energization duty in accordance with the engine condition during the preheat period. The preheat temperature of the sensor element is controlled to a high temperature within a temperature range in which an element breaking caused by adhesion of water does not occur. Referring to FIG. 16, the processes of the heater energization control will be described below.

The heater energization control is repeatedly executed in predetermined cycles during the ON-period of the ignition switch (not shown). This control corresponds to a preheat control means. The computer determines whether the preheat period has been finished in step 1101. When the preheat period has been finished, the procedure advances to step 1109 in which an activation control is performed to increase the heater energization duty and to make the temperature of the sensor element rise to the activation temperature. The heater energization duty is controlled so as to maintain the sensor element in an active state.

Figure 17:
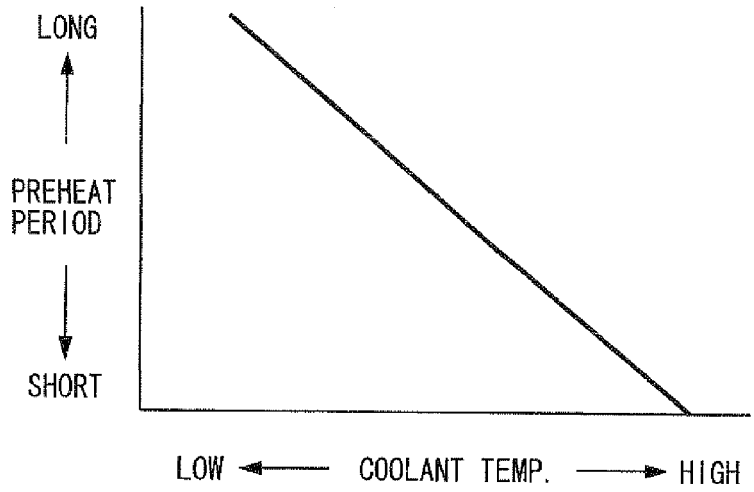
FIG. 17 is a diagram conceptually showing a preheat period setting map according to the tenth embodiment.

When the computer determines in step 1101 that the preheat period has not been finished yet, the procedure advances to step 1102. In step 1102, the computer determines whether the shift range of the automatic transmission is the P-range or the N-range (or the vehicle is being stopped). When the shift range is the P-range or the N-range, the procedure advances to step 1103 in which the computer determines whether the preheat period and the heater energization duty are established. If the preheat period and the heater energization duty are not established yet, the procedure advances to step 1104 in which the preheat period is established in accordance with the engine condition during starting period with reference to a map. The engine condition during starting period includes a coolant temperature. With reference to the preheat period setting map shown in FIG. 17, the preheat period is established in such a manner that as the coolant temperature is lower, the preheat period is longer. The engine condition during starting period includes not only the coolant temperature but also an intake air temperature, an ambient temperature, an oil temperature, and the like. The preheat period may be established in accordance with the lowest temperature among the above temperatures. Further, the preheat period may be corrected in accordance with the difference between the coolant temperature and the ambient temperature (or the difference between the coolant temperature and the intake air temperature).

After that, in step 1105, the reference heater energization duty during the preheat period is established with reference to a map or the like in accordance with the engine condition during starting period. The engine condition during starting period includes, for example, the engine cooling water temperature. As shown in the reference heater energization duty setting map of FIG. 18, the reference heater energization duty is established in such a manner as to decrease along with a decrease in the coolant temperature. The lower the cooling water temperature during starting period is, the more condensate water is generated in the exhaust pipe 23. The reference heater energization duty may be established in accordance with the lowest temperature among the coolant temperature, an intake air temperature, an ambient temperature, and an oil temperature. The reference heater energization duty may be corrected in accordance with a difference between the coolant temperature during starting period of engine and an ambient temperature (or a difference between a coolant temperature and an intake air temperature).

The processes of establishing the preheat period and the reference heater energization duty in step 1104 and step 1105 are performed only once during starting period of engine in step 1103.

Figure 18:
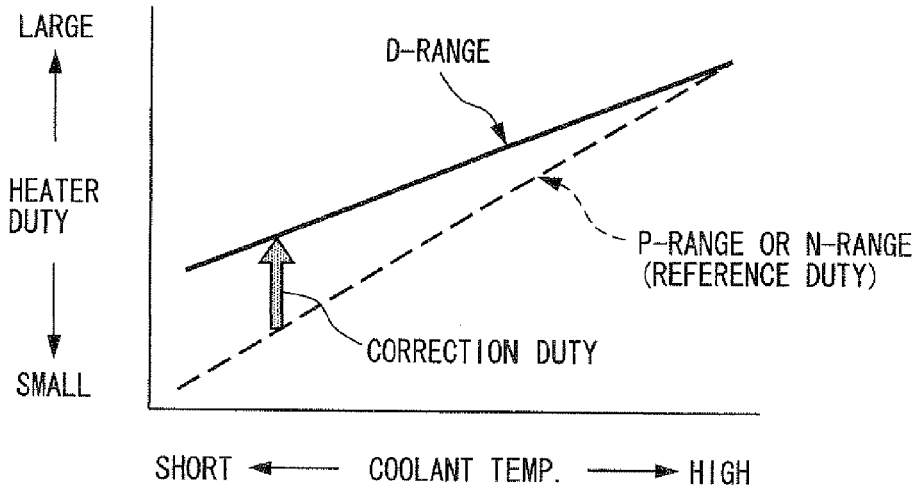
FIG. 18 is a diagram conceptually showing a reference heater energization duty setting map according to the tenth embodiment.

When the computer determines in step 1102 that the shift range is switched from the P-range or the N-range to the D-range, the procedure advances to step 1106 in which a correction duty corresponding to the D-range is established. When the shift range is switched from the P-range or the N-range to the D-range during the catalyst early warm-up control immediately after starting period of engine, the target idle speed drops and the exhaust heat amount decreases. Consequently, according to the present embodiment, the shift range during the preheat period is used as the engine condition during the preheat period. When the shift range is switched to the D-range, a correction duty for the reference heater energization duty is established, and the heater energization duty during the preheat period is corrected so as to be increased. The correction duty may be a preset constant value or may be changed according to the engine conditions during starting period such as the coolant temperature or according to the reference heater energization duty. For example, as shown in FIG. 18, the correction duty may be decreased as the coolant temperature increases (or as the reference heater energization duty becomes large).

According to the present invention, the correction duty may be established based on at least one of the shift range, an engine speed, an ignition timing, and an intake air flow rate as an engine conditions during the preheat period. Generally, as the engine speed becomes higher, the exhaust heat quantity increases. When the ignition timing is delayed, the exhaust temperature rises. As the intake air flow rate increases, the exhaust heat amount increases. When the engine speed becomes higher by a predetermined value or more, the correction duty may be established so that the heater energization duty during the preheat period is decreased. When the ignition timing is advanced by a predetermined value or more, the correction duty may be established so as to increase the heater energization duty during the preheat period. When the intake air flow rate increases by a predetermined value or more, the correction duty may be established so as to decrease the heater energization duty during the preheat period.

The number of times of establishing (changing) the correction duty in step 1106 may be limited to a predetermined number or only once.

As described above, the preheat period and the reference heater energization duty are established based on the engine condition during starting period in steps 1103 and 1104. In step 1106, the correction duty for the reference heater energization duty is established in accordance with the engine condition during the preheat period. After that, in step 1107, the heater energization duty during the preheat period is established by adding the correction duty to the reference heater energization duty.

Heater energization duty during preheat period=Reference heater energization duty+Correction duty Since the correction duty establishing process in step 1106 is not performed until the shift range is switched to the D-range after starting period of engine, the reference heater energization duty is established as the heater energization duty during the preheat period.

Heater energization duty during preheat period=Reference heater energization duty Then, the procedure advances to step 1108 in which the computer determines whether the elapsed time after starting period exceeds the preheat period. When the elapsed time after starting period of engine does not exceed the preheat period, the procedure advances to step 1110 in which the preheat control for energizing the heaters 27, 28 is performed with the heater energization duty during the preheat period established in step 1107.

When the elapsed time after starting period of engine exceeds the preheat period, the procedure advances to step 1109. The heater energization duty is increased to make the temperature of the sensor element rise to the activation temperature. An activation control is performed so that the heater energization duty is controlled so as to maintain the sensor element in an active state.

In a case that the shift range is switched from the P-range (or the N-range) to the P-range (or the N-range) through the D-range during the preheat period, when the shift range is switched from the D-range to the P-range (or the N-range), the answer in step 1102 is Yes. Thus, the correction duty establishing process in the step 1106 is not performed. Consequently, also after the switch to the P-range (or the N-range), the preheat control is executed with the heater energization duty corrected so as to be increased with the correction duty which is established in the D-range. After the range is switched to the P-range (or the N-range), the correction duty may be cancelled to "0" to reset the heater energization duty to the heater energization duty (reference heater energization duty) corresponding to the P-range or the N-range.

The preheat period and the heater energization duty during the preheat period of the upstream exhaust gas sensor 25 and those of the downstream exhaust gas sensor 26 may be established independently from each other.

Figure 19:
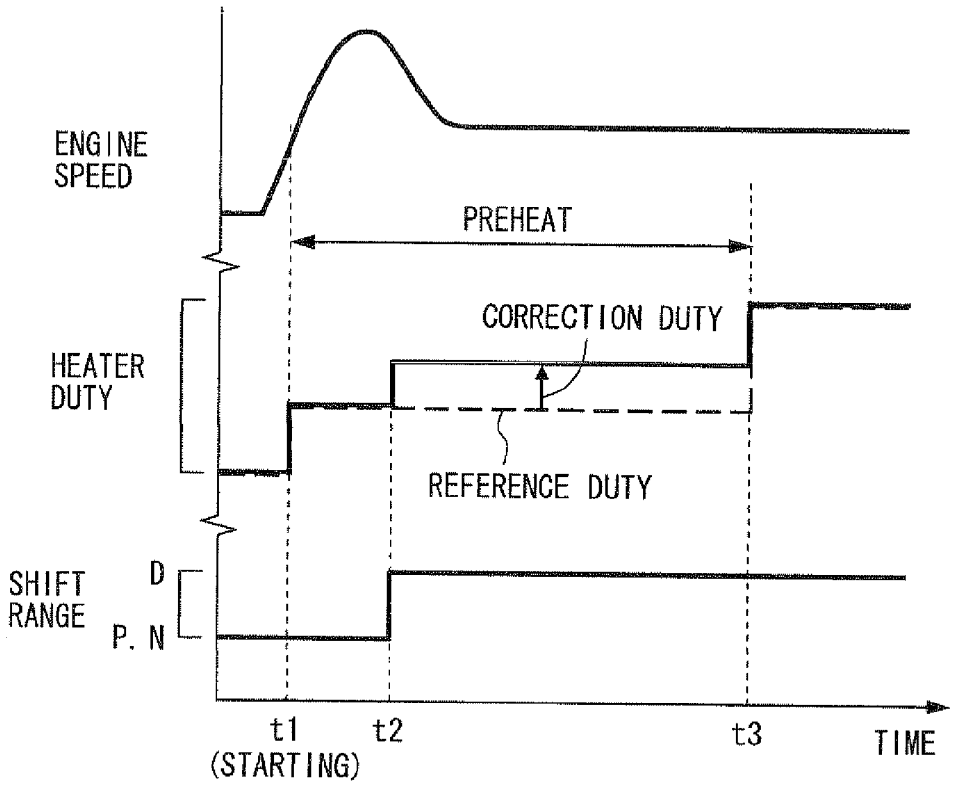
FIG. 19 is a time chart showing a preheat control according to the tenth embodiment.

FIG. 19 is a time chart showing a preheat control in the present embodiment. It is determined that the engine is started at time t1. The preheat period and the reference heater energization duty are established based on the engine condition during starting period. When the shift range is switched from the P-range or the N-range to the D-range before the elapsed time after starting period of engine exceeds the preheat period (before time t3), the correction duty corresponding to the D-range is established at time t2, and the heater energization duty during the preheat period is increased by adding the correction duty to the reference heater energization duty. After that, when the elapsed time after starting period of engine exceeds the preheat period at time t3, the preheat control shifts to activation control. The heater energization duty is increased to make the temperature of the sensor element rise to the activation temperature. The heater energization duty is controlled so as to maintain the sensor element in the active state.

When the shift range is not switched to the D-range before the elapsed time after starting period of engine exceeds the preheat period (before t3) and continuous time of the P-range or the N-range after starting period exceeds the preheat period, the reference heater energization duty becomes the heater energization duty in the preheat period. When the elapsed time after starting period of engine exceeds the preheat period at time t3, the activation control is started.

When the shift range is switched to the D-range during the preheat period and the exhaust heat quantity decreases, the quantity of heat applied to the sensor element is also decreased. According to the tenth embodiment, the heater energization duty (heat generation quantity) is corrected so as to be increased to compensate the decrease in heat quantity. The preheat temperature of the sensor element determined based on the heat generation quantity and the exhaust heat quantity of the heaters 27, 28 can be controlled to a temperature within a temperature range in which an element breaking caused by adhesion of water does not occur. While preventing an element breaking of the exhaust gas sensors 25, 26, early activation of the sensor element can be realized.

In the tenth embodiment, the heater energization duty during the preheat period is corrected based on the engine condition by adding the correction duty during the preheat period to the reference heater energization duty. It is also possible to establish a correction coefficient for the reference heater energization duty based on the engine conditions during the preheat period, and multiply the reference heater energization delay time by the correction coefficient, thereby correcting the heater energization duty in accordance with the operation conditions during the preheat period.

Heater energization duty during preheat period=Reference heater energization duty×Correction coefficient

[Eleventh Embodiment]

Figure 21:
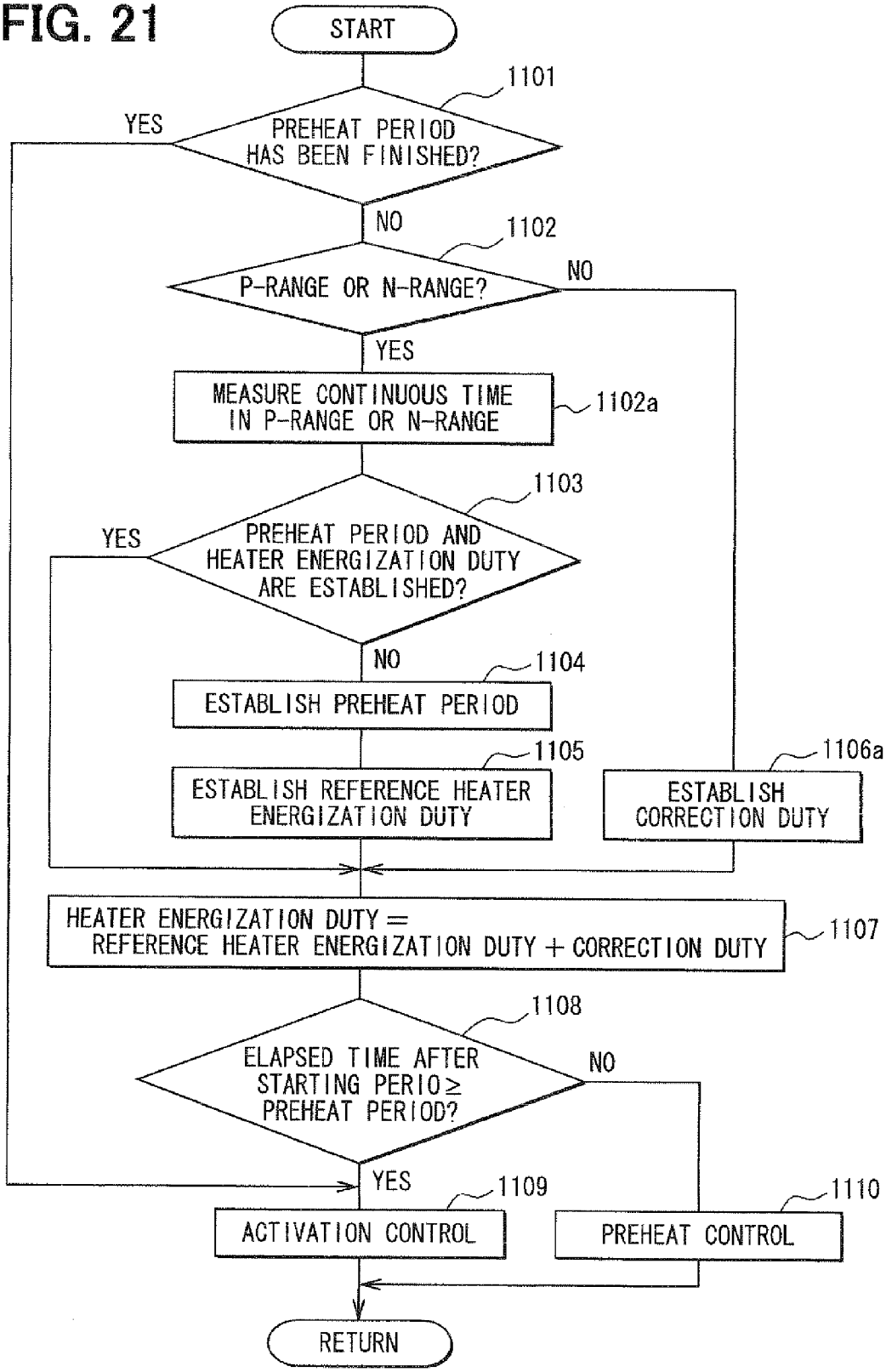
FIG. 21 is a flowchart showing a heater energization control according to an eleventh embodiment.
Figure 22:
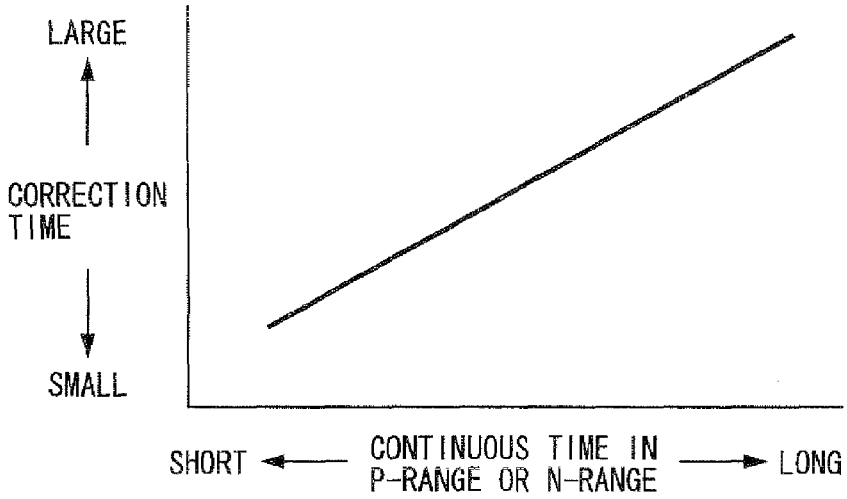
FIG. 22 is a diagram conceptually showing a correction duty setting map according to the eleventh embodiment.
Figure 23:
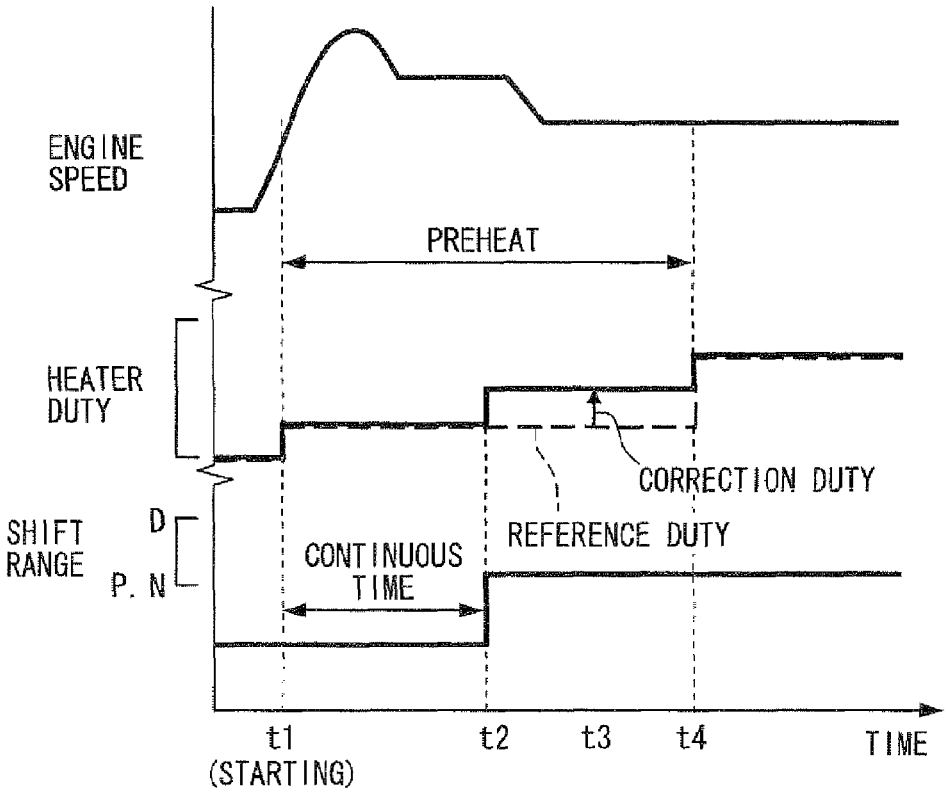
FIG. 23 is a time chart showing a preheat control according to the eleventh embodiment.

In an eleventh embodiment shown in FIGS. 21 to 23, the correction duty is established based on a elapsed time after starting period of engine until the engine condition changes, whereby the heater energization duty during the preheat period is corrected based on the elapsed time after starting period of engine until the operating conditions change. The other configurations are the same as those of the tenth embodiment.

In a heater energization control program of FIG. 21 executed in the eleventh embodiment, the process of step 1102*a* is added after the step 1102 in FIG. 16 described in the tenth embodiment, and the process of the step 1106 in FIG. 16 is changed to a process of step 1106*a*. The processes of the other steps are similar to those of the steps in FIG. 16.

In the eleventh embodiment, as shown in FIG. 23, at time t1, in a similar manner to the tenth embodiment, the preheat period and the reference heater energization duty are established based on the engine conditions during starting period. After that, as an elapsed time until an engine condition changes, the continuous time in the P-range or the N-range until the range is switched to the D-range after starting period is measured (step 1102*a*). When the range is switched to the D-range at time t2, the correction duty according to the continuous time in the P-range or the N-range is established with reference to the correction duty setting map of FIG. 22 (step 1106*a*). The heater energization duty during the preheat period is established by adding the correction duty to the reference heater energization duty.

Heater energization duty during preheat period=Reference heater energization duty+Correction duty The map for establishing the correction duty shown in FIG. 22 is established in such a manner that as the continuous time in the P-range or the N-range becomes longer, the correction duty to be added to the reference heater energization duty becomes larger. This is based on the fact that the longer the continuous time in the P-range or the N-range is, the higher the temperature in the exhaust pipe 23 is, and the smaller the water amount in the exhaust pipe 23 is. The possibility of element breaking caused by adhesion of water is lowered. After that, when the elapsed time after starting period of engine exceeds the preheat period at time t3, the activation control is started.

Also in the eleventh embodiment, the correction duty may be established according to, as the engine conditions during the preheat period, not only the shift range but also at least one of an engine speed, an ignition timing, and an intake air flow rate.

According to the eleventh embodiment, the heater energization duty is corrected based on an elapsed time until the engine condition changes during the preheat period. Therefore, the precision of correction of the heater energization duty during the preheat period can be enhanced.

[Twelfth Embodiment]

Figure 24:
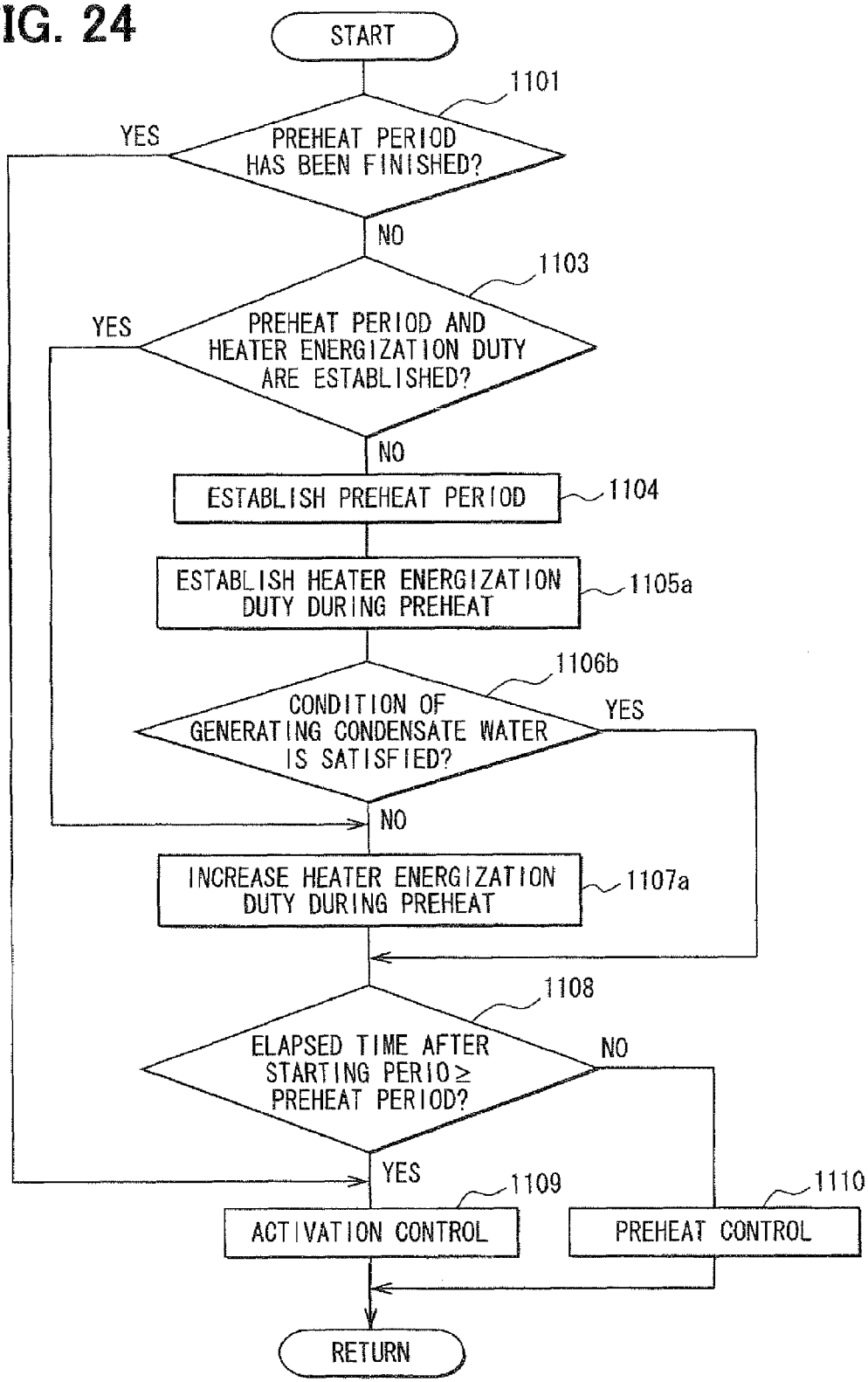
FIG. 24 is a flowchart showing a heater energization control according to a twelfth embodiment.

In a twelfth embodiment, a heater energization control shown in FIG. 24 is executed. In the heater energization control program shown in FIG. 24, the process of the step 1102 in the heater energization control in FIG. 16 is eliminated, and the processes of steps 1105 to 1107 in FIG. 16 are changed to processes of steps 1105*a*, 1106*b*, and 1107*a*. The processes of the other steps are the same as those of steps in FIG. 16.

In a similar manner to the tenth embodiment, a preheat time is established with reference to a map in accordance with the engine condition during starting period (step 1104), and further, the heater energization duty, which corresponds to the reference heater energization duty in the tenth embodiment, is established (step 1105*a*).

After that, during the preheat period, the procedure advances to step 1106*b* in which the computer determines whether a condition of generating condensate water in the exhaust pipe 23 is satisfied. When the computer determines that the condition of generating condensate water is satisfied, the heater energization duty during the preheat period is not changed. However, when the computer determines that the condition of generating condensate water in the exhaust pipe 23 is not satisfied (that is, condensate water is not generated), the procedure advances to step 1107*a* in which the heater energization duty during the preheat period is increased. The increase quantity of the heater energization duty may be a preset constant value. Alternatively, an increase quantity of the heater energization duty may be established with reference to a map based on an elapsed time after starting period of engine. For example, as the elapsed time after starting period is longer, the increase quantity of the heater energization duty may be increased.

According to the twelfth embodiment, during the preheat period, the heater energization duty is increased within the range in which element breaking in the exhaust gas sensors 25, 26 can be prevented, and the preheat temperature of the sensor element can be controlled to a high temperature. Thus, early activation of the exhaust gas sensors 25, 26 can be realized.

[Thirteenth Embodiment]

Figure 25:
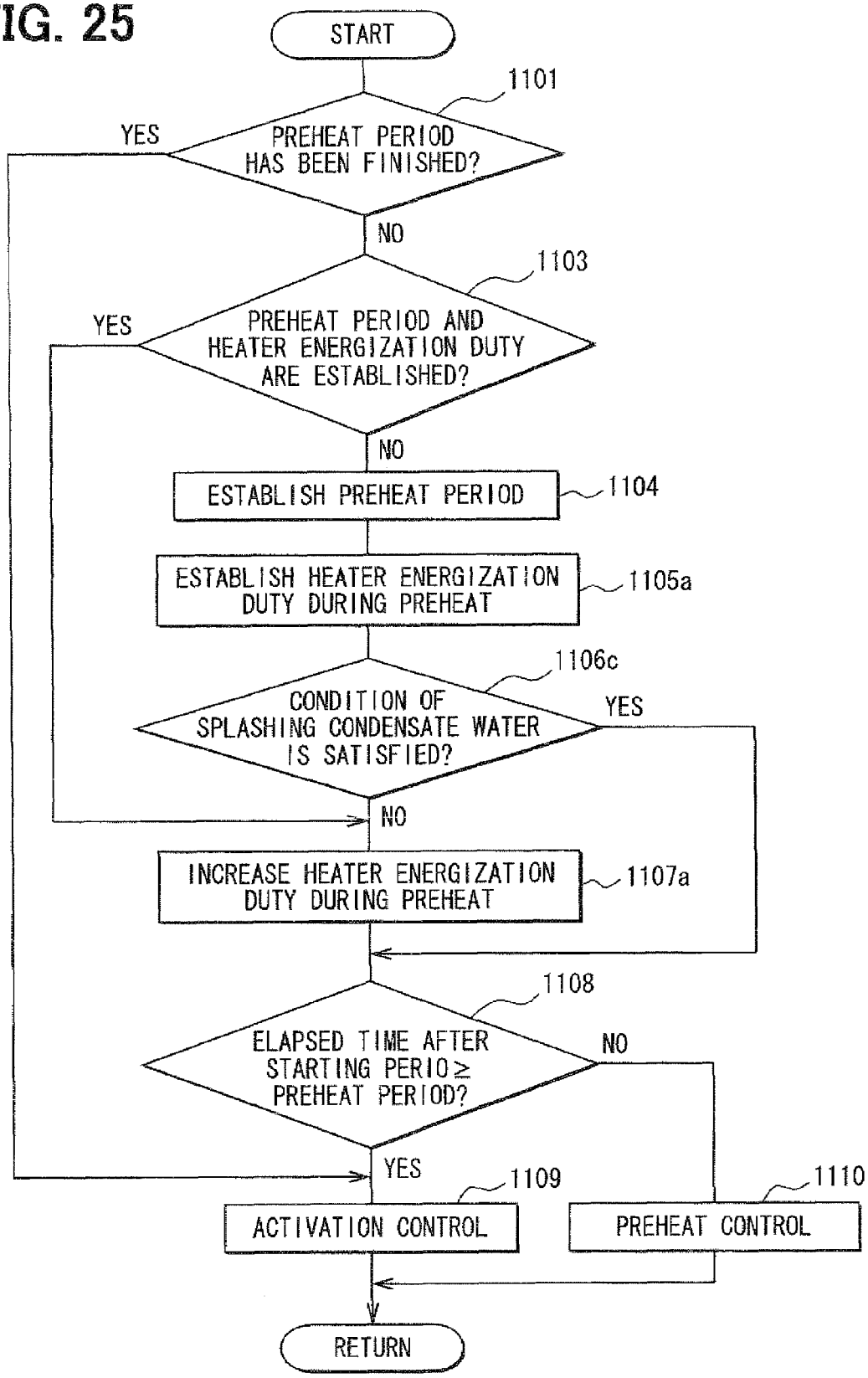
FIG. 25 is a flowchart showing a heater energization control according to a thirteenth embodiment.

In a thirteenth embodiment, a heater energization control shown in FIG. 25 is executed. In the heater energization control shown in FIG. 25, the process of the step 1106*b* in the heater energization control program of FIG. 24 is just changed to a process in step 1106*c*. The processes of the other steps are the same as those of steps in FIG. 24.

During the preheat period, the computer determines whether the condition that condensate water in the exhaust pipe 23 is splashed is satisfied in step 1106*c*, When the compute determines that the condition of splash of the condensate water is satisfied, the heater energization duty during the preheat period is not changed However, when the computer determines that the condition of splash of the condensate water is not satisfied (that is, when it is determined that the condense water is not going to be splashed), the procedure advances to step 1107*a* in which the heater energization duty during the preheat period is increased. The increase quantity of the heater energization duty may be a preset constant value. Alternatively, an increase quantity of the heater energization duty may be established with reference to a map based on an elapsed time after starting period of engine. For example, the heater energization duty is established in such a manner as to increase along with an increase in the elapsed time after starting period of engine.

According to the thirteenth embodiment, during the preheat period, the heater energization duty is increased within the range in which an element breaking in the exhaust gas sensors 25, 26 can be prevented, and the preheat temperature of the sensor element can be controlled to high temperature. Thus, early activation of the exhaust gas sensors 25, 26 can be realized.

The present invention can be applied only to a heater energization control of the upstream exhaust gas sensor 25.

What is claimed is:

1. A heater controller of an exhaust gas sensor having a heater for heating a sensor element of an exhaust gas sensor provided in an exhaust passage of an internal combustion engine, the heater controller comprising:

an energization control means for controlling an energization of the heater to control a temperature of the sensor element;

a delay time establishing means for establishing a heater energization delay time until a start of energization of the heater based on a condition of the internal combustion engine during starting period; and a delay time correcting means for shortening the heater energization delay time in a state where a condensate water is hardly generated in the exhaust passage after starting period of the internal combustion engine, wherein the energization control means starts the energization of the heater when the heater energization delay time has elapsed after starting period of the internal combustion engine.

2. A heater controller of an exhaust gas sensor having a heater for heating a sensor element of an exhaust gas sensor provided in an exhaust passage of an internal combustion engine, the heater controller comprising:

an energization control means for controlling an energization of the heater to control a temperature of the sensor element;

a delay time establishing means for establishing a heater energization delay time until a start of energization of the heater based on a condition of the internal combustion engine during starting period; and a delay time correcting means for shortening the heater energization delay time when a determination is made that condensate water generated in the exhaust passage after starting period of the internal combustion engine is hardly splashed, wherein the energization control means starts the energization of the heater when the heater energization delay time has elapsed after starting period of the internal combustion engine.

3. A heater controller of an exhaust gas sensor having a heater for heating a sensor element of an exhaust gas sensor provided in an exhaust passage of an internal combustion engine, the heater controller comprising:

a processing system, comprising a computer processor, configured to:

control an energization of the heater to control a temperature of the sensor element;

establish a heater energization delay time until a start of energization of the heater based on a condition of the internal combustion engine during starting period;

shorten the heater energization delay time in a state where a condensate water is hardly generated in the exhaust passage after starting period of the internal combustion engine; and start the energization of the heater when the heater energization delay time has elapsed after starting period of the internal combustion engine,

4. A heater controller of an exhaust gas sensor having a heater for heating a sensor element of an exhaust gas sensor provided in an exhaust passage of an internal combustion engine, the heater controller comprising:

a processing system, comprising a computer processor, configured to:

control an energization of the heater to control a temperature of the sensor element;

establish a heater energization delay time until a start of energization of the heater based on a condition of the internal combustion engine during starting period;

shorten the heater energization delay time when a determination is made that condensate water generated in the exhaust passage after starting period of the internal combustion engine is hardly splashed; and start the energization of the heater when the heater energization delay time has elapsed after starting period of the internal combustion engine.

* * * * *